US010682854B2

(12) United States Patent
Yazaki

(10) Patent No.: US 10,682,854 B2
(45) Date of Patent: Jun. 16, 2020

(54) LIQUID EJECTING HEAD, LIQUID EJECTING APPARATUS, PIEZOELECTRIC DEVICE, AND METHOD OF MANUFACTURING LIQUID EJECTING HEAD

(71) Applicant: SEIKO EPSON CORPORATION, Tokyo (JP)

(72) Inventor: Shiro Yazaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/127,722

(22) Filed: Sep. 11, 2018

(65) Prior Publication Data

US 2019/0077147 A1 Mar. 14, 2019

(30) Foreign Application Priority Data

Sep. 13, 2017 (JP) ..... 2017-175477

(51) Int. Cl.
*B41J 2/14* (2006.01)
*B41J 2/175* (2006.01)
*B41J 2/16* (2006.01)

(52) U.S. Cl.
CPC ..... *B41J 2/14233* (2013.01); *B41J 2/1628* (2013.01); *B41J 2/1629* (2013.01); (Continued)

(58) Field of Classification Search
CPC ..... B41J 2/14233; B41J 2002/14241; B41J 2002/14419; B41J 2/14201; B41J 2/17563; B41J 2002/14403
See application file for complete search history.

(56) References Cited

U.S. PATENT DOCUMENTS

2003/0156162 A1 8/2003 Hirota et al.
2003/0160841 A1 8/2003 Takata et al.
(Continued)

FOREIGN PATENT DOCUMENTS

EP 0985535 A2 3/2000
EP 2535189 A1 12/2012
(Continued)

OTHER PUBLICATIONS

Partial European Search Report issued in Application No. 18194322 dated Jan. 28, 2019.

*Primary Examiner* — Geoffrey S Mruk
(74) *Attorney, Agent, or Firm* — Workman Nydegger

(57) ABSTRACT

A liquid ejecting head including a flow path forming substrate on which a pressure generation chamber and a first liquid supply chamber communicating with the pressure generation chamber are formed, a vibration plate that is formed on one surface side of the flow path forming substrate, a piezoelectric element that is provided on the vibration plate at a position corresponding to the first pressure generation chamber, a first filter that is provided on the one surface side of the flow path forming substrate and in which a plurality of first liquid supply ports communicating with the first liquid supply chamber are formed, and a second filter that is provided on an upstream side of the first filter and provided with a plurality of second liquid supply ports, in which an inner diameter of the second liquid supply port is an inner diameter or larger of the first liquid supply port.

19 Claims, 10 Drawing Sheets

(52) U.S. Cl.
CPC ..... *B41J 2/1642* (2013.01); *B41J 2/17563* (2013.01); *B41J 2002/14241* (2013.01); *B41J 2002/14403* (2013.01); *B41J 2002/14419* (2013.01)

(56) References Cited

U.S. PATENT DOCUMENTS

| | | | | |
|---|---|---|---|---|
| 2004/0227797 | A1 | 11/2004 | Shimizu et al. | |
| 2010/0073446 | A1 | 3/2010 | Shimizu | |
| 2010/0328409 | A1* | 12/2010 | Matsufuji ..... | B41J 2/14233 347/93 |
| 2012/0320131 | A1 | 12/2012 | Kato et al. | |
| 2014/0152747 | A1 | 6/2014 | Lee et al. | |

FOREIGN PATENT DOCUMENTS

| | | | |
|---|---|---|---|
| JP | 2008018662 | A | 1/2008 |
| JP | 2013-000993 | A | 1/2013 |
| JP | 2014037131 | A | 2/2014 |
| JP | 2015-016648 | A | 1/2015 |
| JP | 2016-112888 | A | 6/2016 |
| JP | 2017-024334 | A | 2/2017 |

* cited by examiner

LIQUID EJECTING HEAD, LIQUID EJECTING APPARATUS, PIEZOELECTRIC DEVICE, AND METHOD OF MANUFACTURING LIQUID EJECTING HEAD

The entire disclosure of Japanese Patent Application No. 2017-175477, filed Sep. 13, 2017 is expressly incorporated by reference herein.

BACKGROUND

1. Technical Field

The present invention relates to a liquid ejecting head that ejects a liquid, a liquid ejecting apparatus including the liquid ejecting head, a piezoelectric device including a piezoelectric element, and a method of manufacturing the liquid ejecting head.

2. Related Art

As a piezoelectric device used in an ink jet type recording head which is a typical example of a liquid ejecting head, there is a device including an individual flow path communicating with a nozzle, a flow path forming substrate provided with a liquid supply chamber communicating with the individual flow path, and a piezoelectric element provided on one surface side of the flow path forming substrate via a vibration plate.

An ink jet type recording head having such a piezoelectric device is disclosed in a configuration in which a plurality of liquid supply ports communicating with the liquid supply chamber are provided in the vibration plate so that the vibration plate functions as a filter for capturing a foreign matter (for example, refer to JP-A-2013-993).

However, when a relatively fine filter is provided in the flow path, there is a problem that clogging occurs due to the foreign matter contained in the ink, and ejection failure is likely to occur due to poor supply of ink. In addition, when a coarse filter is provided in the flow path, there is a problem that the foreign matter contained in the ink flows downstream without being captured by the filter, and the ejection failure due to the foreign matter is likely to occur.

Such a problem exists not only in an ink jet type recording head but also in a liquid ejecting head which ejects liquid other than ink.

Such a problem is not limited to a liquid ejecting head represented by an ink jet type recording head, but also exists in a piezoelectric device.

SUMMARY

An advantage of some aspects of the invention is to provide a liquid ejecting head, a liquid ejecting apparatus, a piezoelectric device, and a method of manufacturing the liquid ejecting head in which ejection failure of liquid droplets are inhibited.

According to an aspect of the invention, there is provided a liquid ejecting head including a nozzle that ejects a liquid, a flow path forming substrate on which a pressure generation chamber communicating with the nozzle and a first liquid supply chamber communicating with the pressure generation chamber are formed, a vibration plate that is formed on one surface side of the flow path forming substrate, a piezoelectric element that is provided on the vibration plate at a position corresponding to the first pressure generation chamber, a first filter that is provided on the one surface side of the flow path forming substrate and in which a plurality of first liquid supply ports communicating with the first liquid supply chamber are formed, a protective substrate that is provided on the one surface side of the flow path forming substrate and provided with a second liquid supply chamber communicating with the first liquid supply chamber via the first liquid supply port, and a second filter that is provided on an upstream side of the first filter and provided with a plurality of second liquid supply ports, in which an inner diameter of the second liquid supply port is an inner diameter or larger of the first liquid supply port.

In this case, by providing the first filter and the second filter, it is possible to capture the foreign matter with a two-stage filters, and as compared with the case where only one of the filters is provided, it is possible to inhibit clogging of the filter due to the foreign matter.

In addition, since the inner diameter of the second liquid supply port is the inner diameter or larger of the first liquid supply port of the first filter, a larger foreign matter is captured by the second filter, and the foreign matter smaller than the second liquid supply port which cannot be captured by the second filter can be captured by the first filter. Therefore, since the relatively large foreign matter can be captured by the second filter, the first liquid supply port of the first filter is inhibited from being covered with the large foreign matter and the clogging of the first filter can be reduced.

In the liquid ejecting head, it is preferable that the first filter be formed by at least a portion of the vibration plate. In this case, since at least a portion of the second filter can be simultaneously formed by the step of forming the vibration plate, the step of forming the second filter can be omitted to reduce the cost.

In the liquid ejecting head, it is preferable that the inner diameter of the first liquid supply port be an inner diameter of the nozzle or less. In this case, the foreign matters which cause clogging of the nozzle can be surely captured by the first filter and clogging of the nozzle can be inhibited.

In the liquid ejecting head, it is preferable that the second liquid supply chamber be provided penetrating the protective substrate in a lamination direction of the protective substrate and the flow path forming substrate, and the second filter be provided in an opening of the second liquid supply chamber on a surface of the protective substrate opposite to the flow path forming substrate. In this case, by providing the second filter at the opening of the second liquid supply chamber, the second filter can be disposed as close as possible to the first filter. Therefore, a flow path length between the second filter and the first filter is shortened, and the foreign matter is hardly generated between the second filter and the first filter. Even if the foreign matter occurs on the upstream side, the foreign matter can be captured by the second filter and clogging of the first filter due to the foreign matter can be inhibited.

The liquid ejecting head further includes a flow path member that has a third liquid supply chamber communicating with the second liquid supply chamber via the second liquid supply port, on a surface of the protective substrate opposite to the flow path forming substrate, it is preferable that the flow path member include a beam portion that supports a surface of the second filter on the flow path member side. In this case, by providing the beam portion, deformation of the second filter toward the flow path member side can be inhibited, and breakage due to deformation of the second filter can be inhibited.

In the liquid ejecting head, it is preferable that the first liquid supply chamber be independently provided in each of the pressure generation chambers. In this case, by providing the first liquid supply chamber independently in each of the pressure generation chambers, the first liquid supply port of the first filter can be caused to function as a throttle flow path for providing flow path resistance. The throttle flow path can be shortened to the flow path forming substrate and the throttle flow path can be inhibited from being provided, so that downsizing can be achieved.

In the liquid ejecting head, it is preferable that a compliance portion having flexibility be provided on a wall surface of the flow path between the first filter and the pressure generation chamber. In this case, the pressure fluctuating toward the upstream side from the pressure generation chamber when liquid droplets are ejected from the nozzle can be absorbed by deformation of the compliance portion. The pressure fluctuation is unlikely to be transmitted to the first filter, and breakage due to deformation of the first filter can be inhibited. In addition, by providing the compliance portion at a position close to the pressure generation chamber, it is possible to absorb the pressure fluctuating toward the upstream side from the pressure generation chamber in a short time. It is possible to shorten the drive cycle for driving the piezoelectric element, and to continuously eject ink droplets in a short time.

According to another aspect of the invention, there is provided a liquid ejecting apparatus including the above-described liquid ejecting head.

In this case, it is possible to realize the liquid ejecting apparatus in which ejection failure of liquid droplets is inhibited.

According to still another aspect of the invention, there is provided a piezoelectric device which is used in a liquid ejecting head for ejecting a liquid from a nozzle, including a flow path forming substrate on which a pressure generation chamber communicating with the nozzle and a first liquid supply chamber communicating with the pressure generation chamber are formed, a vibration plate that is formed on one surface side of the flow path forming substrate, a piezoelectric element that is provided on the vibration plate at a position corresponding to the first pressure generation chamber, a first filter that is provided on the one surface side of the flow path forming substrate and in which a plurality of first liquid supply ports communicating with the first liquid supply chamber are formed, a protective substrate that is provided on the one surface side of the flow path forming substrate and provided with a second liquid supply chamber communicating with the first liquid supply chamber via the first liquid supply port, and a second filter that is provided on an upstream side of the first filter and provided with a plurality of second liquid supply ports, in which an inner diameter of the second liquid supply port is an inner diameter of the first liquid supply port or larger.

In this case, by providing the first filter and the second filter, it is possible to capture the foreign matter with a two-stage filters, and as compared with the case where only one of the filters is provided, it is possible to inhibit clogging of the filter due to the foreign matter.

In addition, since the inner diameter of the second liquid supply port is the inner diameter of the first liquid supply port or larger of the first filter, a larger foreign matter is captured by the second filter, and the foreign matter smaller than the second liquid supply port which cannot be captured by the second filter can be captured by the first filter. Therefore, since the relatively large foreign matter can be captured by the second filter, the first liquid supply port of the first filter is inhibited from being covered with the large foreign matter and the clogging of the first filter can be reduced.

According to still another aspect of the invention, there is provided a method of manufacturing of a liquid ejecting head including a nozzle that ejects a liquid, a flow path forming substrate on which a pressure generation chamber communicating with the nozzle and a first liquid supply chamber communicating with the pressure generation chamber are formed, a vibration plate that is formed on one surface side of the flow path forming substrate, a piezoelectric element that is provided on the vibration plate at a position corresponding to the first pressure generation chamber, a first filter that is provided on the one surface side of the flow path forming substrate and in which a plurality of first liquid supply ports communicating with the first liquid supply chamber are formed, a protective substrate that is provided on the one surface side of the flow path forming substrate and provided with a second liquid supply chamber communicating with the first liquid supply chamber via the first liquid supply port, and a second filter that is provided on a surface of the protective substrate opposite to the flow path forming substrate and in which a plurality of second liquid supply ports communicating with the second liquid supply chamber are formed, the method including forming a second liquid supply chamber and a second filter on a protective substrate, forming a first protective film having liquid resistance on an inner wall surface of the second liquid supply chamber of the protective substrate and the second filter by a gas phase method, bonding the protective substrate and a flow path forming substrate and forming a pressure generation chamber, a first liquid supply chamber, and a first filter on the flow path forming substrate, and forming a second protective film having liquid resistance on an inner wall of the pressure generation chamber, the first liquid supply chamber, and the second liquid supply chamber, the first filter, and the second filter by a gas phase method in a bonded body in which the protective substrate and the flow path forming substrate are bonded to each other.

In this case, by providing a protective film on the first filter and the second filter, the rigidity of the first filter and the second filter can be improved. Furthermore, by providing the first protective film and the second protective film in separate steps, the protective film can be formed over the inner wall surfaces of the first liquid supply port and the second liquid supply port, so that the first filter and the second filter can be inhibited from being etched by the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
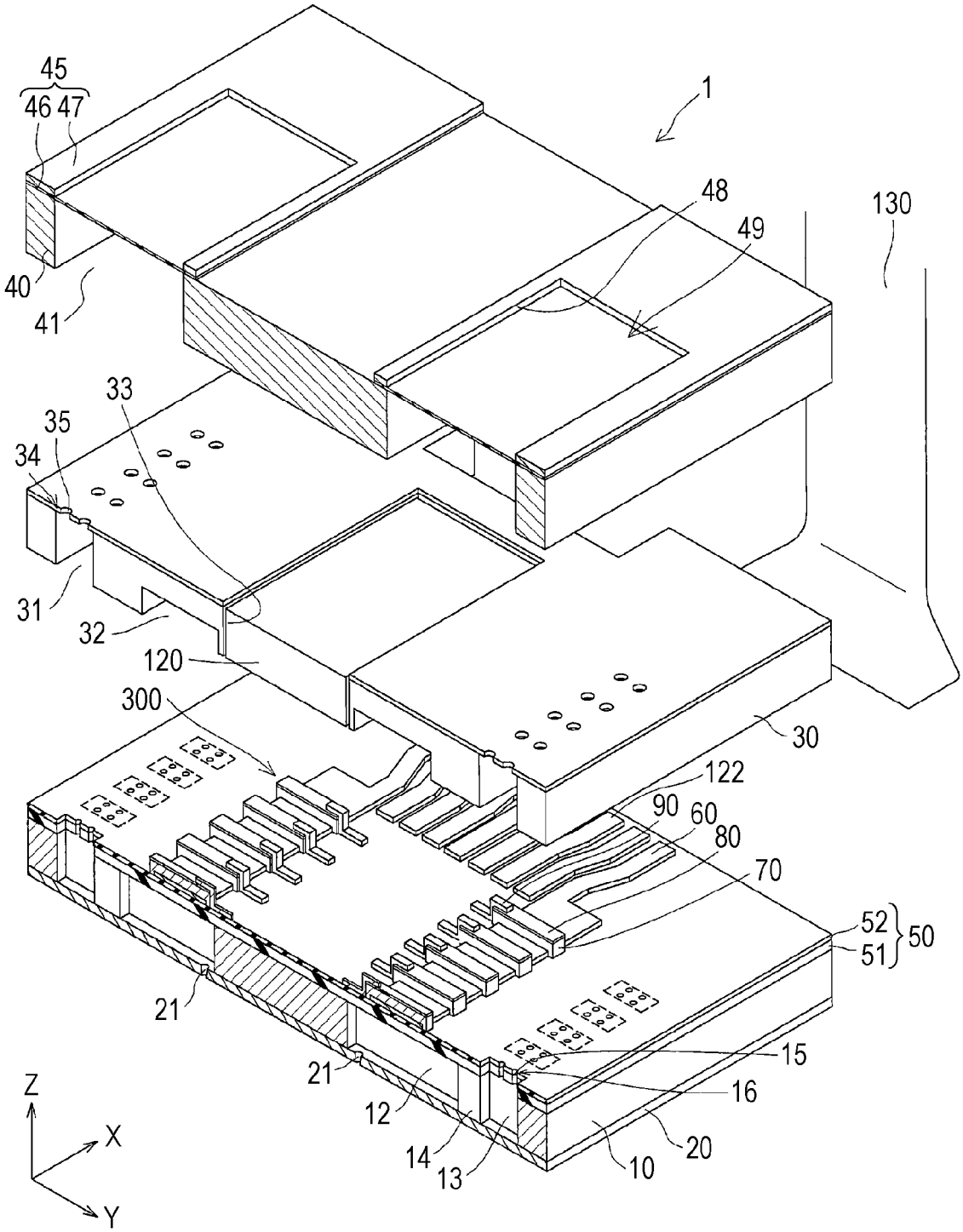
FIG. 1 is an exploded perspective view of a recording head according to Embodiment 1 of the invention.

Hereinafter, the invention will be described with reference to the drawings. However, the following description shows one embodiment of the invention, and it can be arbitrarily changed within the scope of the invention. In the drawings, the same reference numerals are given to the same members, and explanations thereof are omitted as appropriate. In addition, in each drawing, X, Y, and Z represent three spatial axes orthogonal to each other. In the specification, directions along these axes will be described as a first direction X, a second direction Y, and a third direction Z.

Embodiment 1

Figure 2:
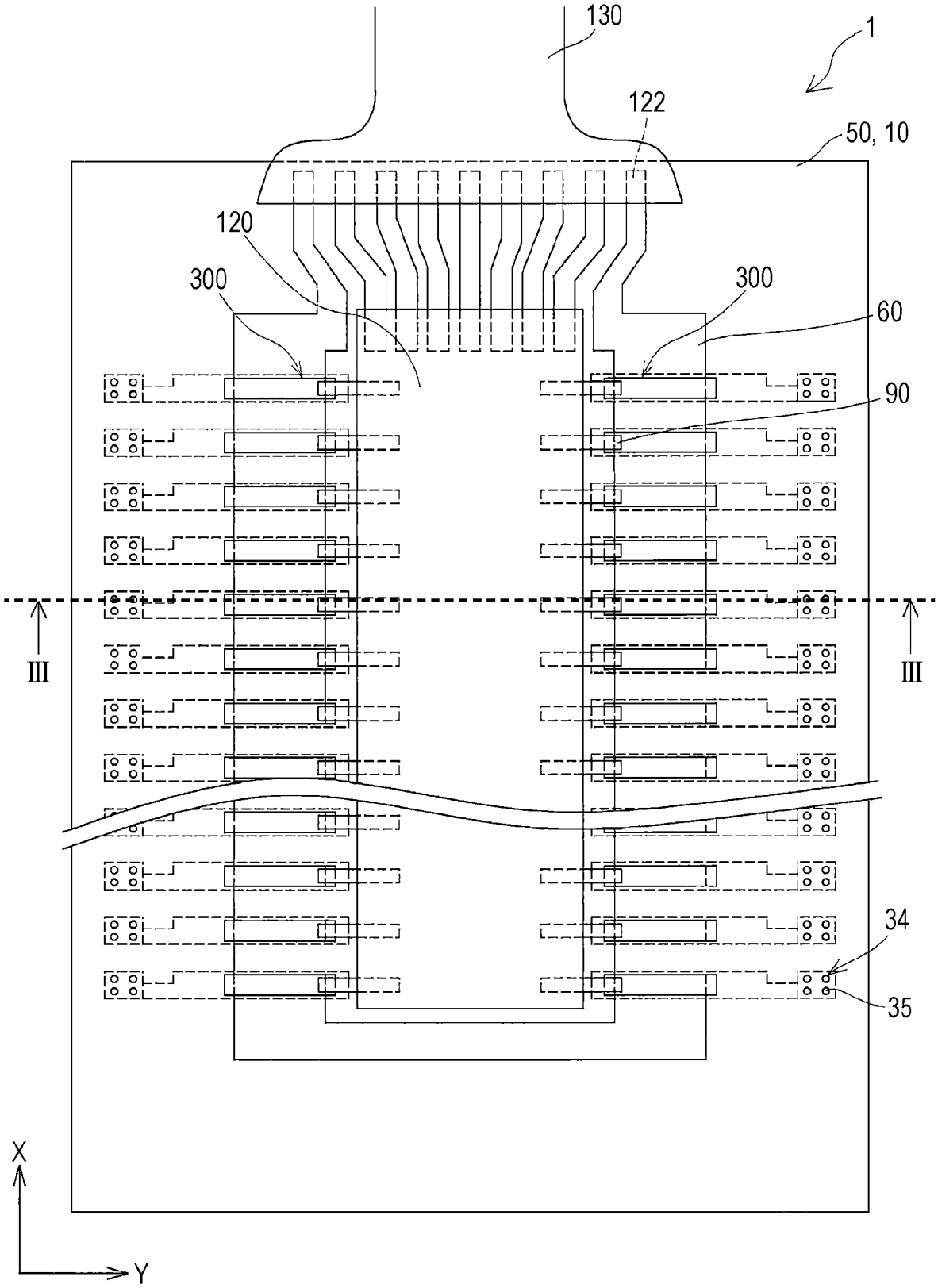
FIG. 2 is a plan view of a main part of the recording head according to Embodiment 1 of the invention.
Figure 3:
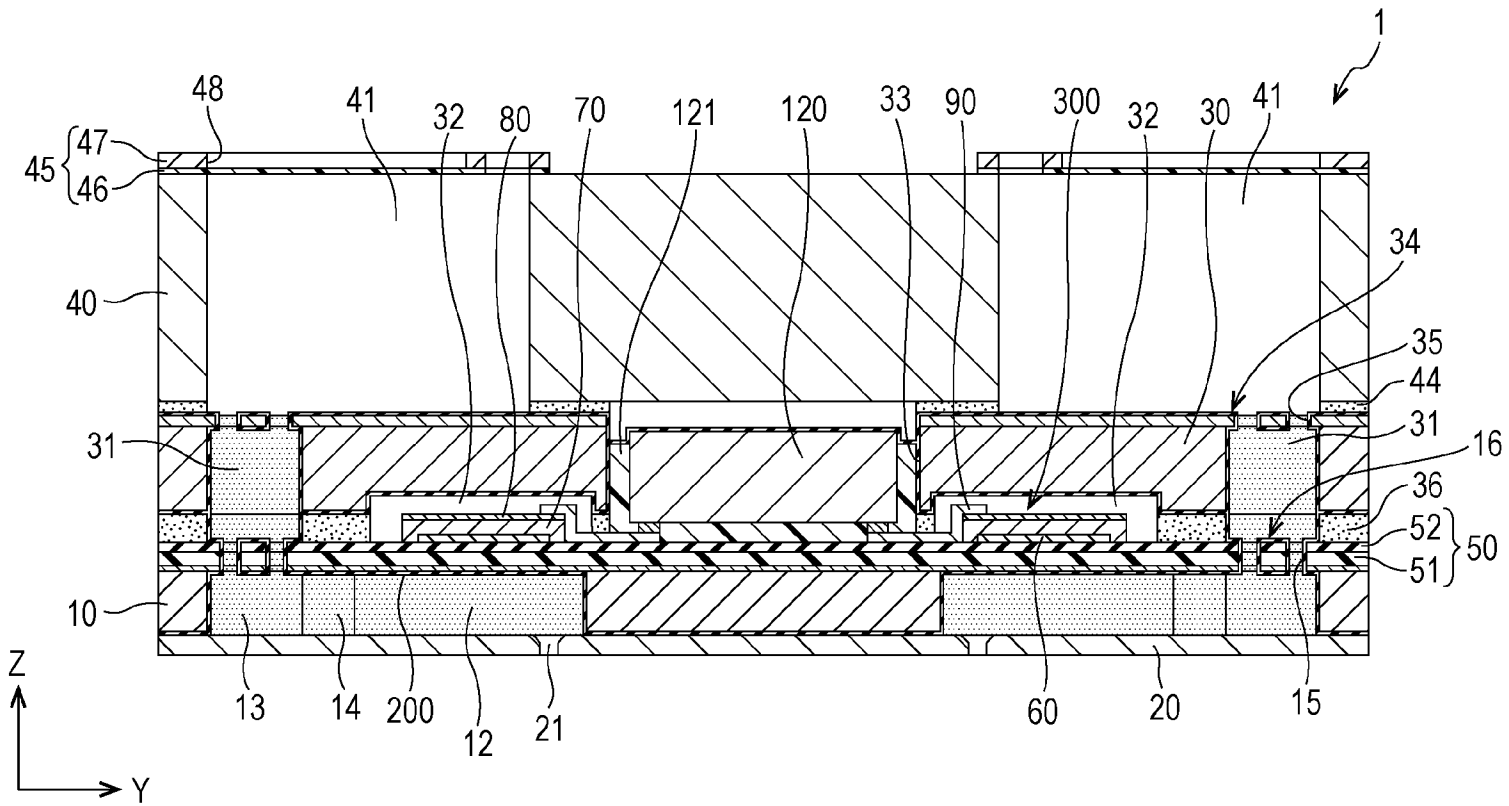
FIG. 3 is a cross-sectional view of the recording head according to Embodiment 1 of the invention.
Figure 4:
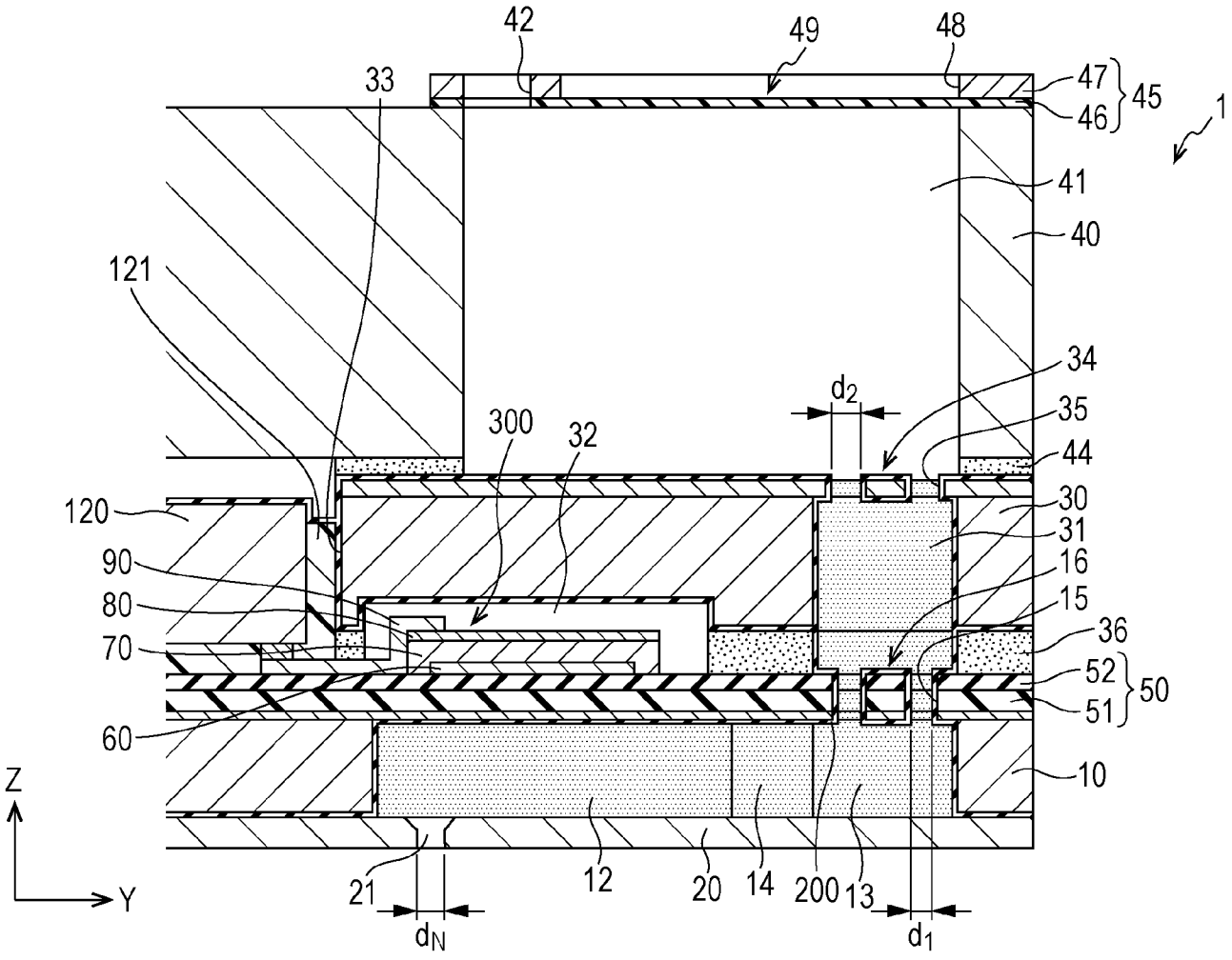
FIG. 4 is an enlarged cross-sectional view of the main part of the recording head according to Embodiment 1 of the invention.

FIG. 1 is an exploded perspective view of an ink jet type recording head which is an example of a liquid ejecting head according to Embodiment 1 of the invention, FIG. 2 is a plan view of a flow path forming substrate of the ink jet type recording head, FIG. 3 is a cross-sectional view of the ink jet type recording head conforming to a line III-III of FIG. 2, and FIG. 4 is an enlarged view of a main part of FIG. 3.

As shown in the drawing, as a flow path forming substrate 10 constituting an ink jet type recording head 1 (hereinafter, simply referred to as recording head 1), a metal such as stainless steel, nickel (Ni), ceramic materials represented by zirconium oxide ($ZrO_X$) or aluminum oxide ($Al_XO_Y$), glass ceramic materials, oxide such as silicon oxide ($SiO_X$), magnesium oxide (MgO), lanthanum aluminate ($LaAlO_3$), or the like can be used. In the embodiment, the flow path forming substrate 10 is made of a silicon single crystal substrate.

The flow path forming substrate 10 is anisotropically etched from one surface side so that pressure generation chambers 12 partitioned by a plurality of partition walls are disposed in parallel along the first direction X in which a plurality of nozzles 21 for ejecting ink are disposed in parallel. In addition, in the flow path forming substrate 10, a plurality of rows in which the pressure generation chambers 12 are disposed in parallel in the first direction are provided in the second direction Y, and two rows are provided in the embodiment. In addition, in the flow path forming substrate 10, an ink supply path 14 and a first liquid supply chamber 13 are partitioned by partition walls on one end side of the pressure generation chamber 12 in the second direction Y. That is, in the embodiment, the flow path forming substrate 10 is provided with the pressure generation chamber 12, the ink supply path 14, and the first liquid supply chamber 13 as individual flow paths communicating with the respective nozzles 21. That is, the first liquid supply chamber 13 of the embodiment is provided independently in each of the pressure generation chambers 12. In the embodiment, although the first liquid supply chamber 13 is provided independently for each of the pressure generation chambers 12, the invention is not limited thereto, and the first liquid supply chamber 13 may be provided so as to communicate in common with a plurality of pressure generation chambers 12. That is, the first liquid supply chamber 13 may constitute a portion of the common liquid chamber communicating in common with the plurality of individual flow paths.

The ink supply path 14 is formed with a width narrower than that of the pressure generation chamber 12 in the first direction X, and keeps the flow path resistance of the ink flowing from the first liquid supply chamber 13 into the pressure generation chamber 12 constant. The ink supply path 14 is not limited to the configuration that narrows the width, and the height in the third direction Z may be narrowed.

In addition, protective films 200 having liquid resistance (ink resistance) are provided on an inner wall surfaces of the pressure generation chamber 12, the first liquid supply chamber 13, and the ink supply path 14 of the flow path forming substrate 10. The liquid resistance (ink resistance) referred to herein means etching resistance to alkaline ink. As such a protective film 200, for example, a single layer or a laminate of at least one material selected from tantalum oxide ($TaO_X$), zirconium oxide ($ZrO_X$), nickel (Ni), and chromium (Cr) can be used. In the embodiment, tantalum pentoxide ($TaO_5$) is used as the protective film.

A nozzle plate 20 in which a nozzle 21 communicating with the vicinity of an end portion of each pressure generation chamber 12 on the side opposite to the ink supply path 14 is formed therein is fixed to the surface of the flow path forming substrate 10 on the side where the pressure generation chamber 12 is open by an adhesive, a heat welding film, or the like. As the nozzle plate 20, a metal such as stainless steel, nickel (Ni), a silicon single crystal substrate, ceramic materials represented by zirconium oxide ($ZrO_X$) or aluminum oxide ($Al_XO_Y$), glass ceramic materials, oxide such as silicon oxide ($SiO_X$), magnesium oxide (MgO), lanthanum aluminate ($LaAlO_3$), or the like can be used.

On the other hand, a vibration plate 50 is formed on the surface of the flow path forming substrate 10 opposite to the nozzle plate 20. The vibration plate 50 of the embodiment is provided with an elastic film 51 including silicon oxide ($SiO_X$) provided on the flow path forming substrate 10 side, an insulator film 52 including zirconium oxide ($ZrO_X$) provided on the elastic film 51. In the embodiment, the elastic film 51 containing silicon dioxide ($SiO_2$) and the insulator film 52 containing zirconium oxide ($ZrO_2$) are used. The pressure generation chamber 12, the first liquid supply chamber 13, and the ink supply path 14 are formed by anisotropically etching the flow path forming substrate 10 from the surface side to which the nozzle plate 20 is bonded, and the surface of the pressure generation chamber 12 opposite to the nozzle plate 20 is partitioned by the elastic film 51.

The vibration plate 50 may be provided with only one of the elastic film 51 and the insulator film 52, or may be further provided with another film in addition to the elastic film 51 and the insulator film 52. In addition, the vibration plate 50 is not limited to the one including silicon oxide and zirconium oxide, and for example, silicon nitride (SiN), titanium oxide ($TiO_X$) or the like may be used. That is, as the vibration plate 50, a single layer or a laminate of at least one material selected from silicon oxide, zirconium oxide, silicon nitride, and titanium oxide can be used.

On the vibration plate 50 of the flow path forming substrate 10, a first electrode 60, a piezoelectric layer 70, and a second electrode 80 are laminated by film formation and lithography to form a piezoelectric element 300. In the embodiment, the piezoelectric element 300 is a drive element that causes pressure change in the ink in the pressure generation chamber 12. Here, the piezoelectric element 300 is referred to as a piezoelectric actuator, and is a portion including the first electrode 60, the piezoelectric layer 70, and the second electrode 80. In general, one of the electrodes of the piezoelectric element 300 is used as a common electrode common to the plurality of piezoelectric elements 300, and the other electrode is configured as an individual electrode independent for each piezoelectric element 300. In the embodiment, the first electrode 60 is used as a common electrode and the second electrode 80 is used as an individual electrode, but this configuration may be reversed.

As the first electrode 60, for example, a noble metal such as platinum (Pt), iridium (Ir), conductive oxides represented by lanthanum nickel oxide (LNO), iridium oxide ($IrO_2$) and the like, or a laminated film thereof, which is a material capable of maintaining conductivity without oxidizing when forming the piezoelectric layer 70, is preferably used.

In addition, as the first electrode 60, an adhesion layer for securing adhesion strength between the above-described conductive material and the vibration plate 50 may be used. In the embodiment, although not shown, titanium is used as the adhesion layer. As the adhesion layer, zirconium, titanium, titanium oxide, or the like can be used. That is, in the embodiment, the first electrode 60 is formed of an adhesion layer made of titanium and at least one conductive layer selected from the above-described conductive materials.

The piezoelectric layer 70 is made of an oxide piezoelectric material having a polarization structure formed on the first electrode 60, may be made of, for example, a perovskite oxide represented by the general formula $ABO_3$, and a lead-based piezoelectric material containing lead, a lead-free piezoelectric material containing no lead, or the like can be used. The piezoelectric layer 70 can be formed by a liquid phase method such as a sol-gel method and a metal-organic decomposition (MOD) method, a physical vapor deposition (PVD) method (gas phase method) such as a sputtering method, and a laser ablation method, for example.

It is desirable that the second electrode 80 can favorably form an interface with the piezoelectric layer 70, and is a material that can exhibit conductivity and piezoelectric characteristics. As the second electrode 80, a noble metal material such as iridium (Ir), platinum (Pt), palladium (Pd), and gold (Au), or a conductive oxide represented by lanthanum nickel oxide (LNO) is preferably used. In addition, the second electrode 80 may be a laminate of a plurality of materials. In the embodiment, a laminated electrode of iridium and titanium (iridium is in contact with piezoelectric layer 70) is used. The second electrode 80 can be formed by a physical vapor deposition (PVD) method (gas phase method) such as a sputtering method, a liquid phase method such as a sol-gel method and a metal-organic decomposition (MOD) method, and a plating method. In addition, by performing heat treatment after forming the second electrode 80, characteristics of the piezoelectric layer 70 can be improved.

Such a second electrode 80 is formed only on the piezoelectric layer 70, that is, only on the surface of the piezoelectric layer 70 on the side opposite to the flow path forming substrate 10.

In addition, a lead electrode 90 made of, for example, gold (Au) or the like is provided from the second electrode 80 of the piezoelectric element 300. One end portion of the lead electrode 90 is connected to the second electrode 80 and the other end portion extends to the side opposite to the ink supply path 14 of the flow path forming substrate 10. A drive circuit 120 made of a semiconductor integrated circuit (IC) for driving the piezoelectric element 300 is flip-chip mounted on the leading end portion of the extended lead electrode 90. In addition, a space between the drive circuit 120 and the flow path forming substrate 10 (vibration plate 50) is filled with a filler 121 which is an underfill agent.

In addition, as shown in FIG. 2, an input wiring 122 is provided on the vibration plate 50 of the flow path forming substrate 10. One end of the input wiring 122 is connected to the drive circuit 120, the other end is extended to one end of the flow path forming substrate 10 in the second direction Y, an external wiring 130 for supplying a signal for controlling the drive of the recording head 1 is connected to the leading end portion of the extended input wiring 122. The external wiring 130 is, for example, a flexible cable such as flexible flat cable (FFC) or flexible printed circuits (FPC). A signal from the external wiring 130 is supplied to the drive circuit 120 via the input wiring 122.

Furthermore, a protective substrate 30 is bonded to the surface of the flow path forming substrate 10 on the piezoelectric element 300 side. In the embodiment, the flow path forming substrate 10 and the protective substrate 30 are bonded using an adhesive 36. As the protective substrate 30, a metal such as stainless steel, nickel (Ni), a silicon single crystal substrate, ceramic materials represented by zirconium oxide ($ZrO_X$) or aluminum oxide ($Al_XO_Y$), glass ceramic materials, oxide such as silicon oxide ($SiO_X$), magnesium oxide (MgO), lanthanum aluminate ($LaAlO_3$), or the like can be used. As such a protective substrate 30, a material having the same linear expansion coefficient as that of the flow path forming substrate 10 is preferable. Incidentally, in a case where the protective substrate 30 is made of a material having a greatly different linear expansion coefficient from that of the flow path forming substrate 10, by being heated or cooled, warpage occurs due to a difference in linear expansion coefficient between the flow path forming substrate 10 and the protective substrate 30. In the embodiment, warpage due to heat can be inhibited by using the same material as the flow path forming substrate 10, that is, a silicon single crystal substrate as the protective substrate 30.

In addition, the protective substrate 30 is provided with a second liquid supply chamber 31 for supplying ink to the first liquid supply chamber 13 of the flow path forming substrate 10. The second liquid supply chamber 31 is provided with a size communicating in common with a plurality of first liquid supply chambers 13. That is, the opening of the second liquid supply chamber 31 on the flow path forming substrate 10 side is provided continuously over the plurality of first liquid supply chambers 13 disposed in parallel in the first direction X, and configures a portion of a common flow path communicating with a plurality of individual flow paths.

The protective film 200 described above is formed on the inner wall of the second liquid supply chamber 31 of the protective substrate 30. That is, the protective film 200 is formed on the inner walls of the flow paths of the pressure generation chamber 12, the ink supply path 14, the first liquid supply chamber 13, and the second liquid supply chamber 31 of the flow path forming substrate 10 and the protective substrate 30.

In addition, the second liquid supply chamber 31 of the protective substrate 30 communicates with the first liquid supply chamber 13 via a plurality of first liquid supply ports 15 and the ink from the second liquid supply chamber 31 is supplied to the first liquid supply chamber 13 via the plurality of first liquid supply ports 15. That is, a first filter 16 in which the plurality of first liquid supply ports 15 formed with at least a portion of the vibration plate 50 and communicating with the first liquid supply chamber 13 are formed is provided on the one surface side of the flow path forming substrate 10 of the protective substrate 30.

Each of the first liquid supply ports 15 has an opening smaller than the opening of the first liquid supply chamber 13 on the side of the second liquid supply chamber 31. The plurality of first liquid supply ports 15 of two or more are provided for the first liquid supply chamber 13. Here, the fact that the plurality of first liquid supply ports 15 are provided for the first liquid supply chamber 13 means that two or more first liquid supply ports 15 are provided for one first liquid supply chamber 13. That is, although the plurality of first liquid supply ports 15 are provided in one recording head 1, those in which one first liquid supply port 15 is provided for one first liquid supply chamber 13 are not included in the "plurality of first liquid supply ports" of the invention.

The first filter 16 having the first liquid supply port 15 formed therein is formed by at least a portion of the vibration plate 50 in the embodiment. Since the vibration plate 50 of the embodiment includes the elastic film 51 and the insulator film 52, the first filter 16 may include at least one of the elastic film 51 and the insulator film 52. That is, the first filter 16 may be formed of at least a portion of the vibration plate 50, and may include other films in addition to at least a portion of the vibration plate 50. As a film other than the vibration plate 50 constituting the first filter 16, for example, at least one selected from films forming the piezoelectric element 300, in particular, the first electrode 60 and the second electrode 80 is used, so that the rigidity and toughness of the first filter 16 can be improved and a step of forming a new film is unnecessary and cost can be reduced. In addition, although not specifically shown, in a case where a protective film for covering and protecting the piezoelectric layer 70 is provided, the protective film may be used for the first filter 16. It goes without saying that a film other than the protective film covering the piezoelectric element 300 and the piezoelectric layer 70 may be used as a film other than the vibration plate 50 forming the first filter 16.

By forming the first filter 16 with at least a portion of the vibration plate 50 in this manner, at least a portion of the first filter 16 can be simultaneously formed by the step of forming the vibration plate 50 and at least a portion of the step of forming the first filter 16 can be omitted. Therefore, the cost can be reduced. It goes without saying that the first filter 16 may be formed of a material other than the vibration plate 50, that is, a material formed by a step separate from the vibration plate 50.

In the embodiment, the vibration plate 50 in which the elastic film 51 and the insulator film 52 are laminated is used as the first filter 16. In addition, the protective film 200 is formed on the surface of the first filter 16 formed by the vibration plate 50. The protective film 200 is formed continuously over the surface of the first filter 16, that is, over the surface on the flow path forming substrate 10 side, the surface on the protective substrate 30 side, and the inner wall surface of the first liquid supply port 15. By providing the protective film 200 on the first filter 16 in this manner, it is possible to inhibit, in particular, the elastic film 51 of the first filter 16 from being etched with ink.

The fact that the first filter 16 is formed by at least a portion of the vibration plate 50 means that a portion of the vibration plate 50 is provided at least in a portion of a periphery of the first liquid supply port 15. That is, the fact that at least a portion of the vibration plate 50 is provided in at least in a portion of the periphery of the first liquid supply port 15 includes a configuration in which at least a portion of the vibration plate 50 is discontinuously provided in the circumferential direction of one first liquid supply port 15, and a configuration in which at least a portion of the vibration plate 50 is provided continuously in the circumferential direction of one first liquid supply port 15. In addition, the fact that at least a portion of the vibration plate 50 is provided in at least a portion of the periphery of the first liquid supply port 15 includes a configuration in which at least a portion of the vibration plate 50 forms a portion of an opening edge portion of the first liquid supply port 15, a configuration in which at least a portion of the vibration plate 50 is formed in a portion between the adjacent first liquid supply ports 15, and a configuration in which at least a portion of the vibration plate 50 is formed in a portion between the first liquid supply port 15 and the flow path wall. In the embodiment, the elastic film 51 and the insulator film 52 are formed continuously in the circumferential direction on the opening edge portion of the first liquid supply port 15.

When the ink is supplied from the second liquid supply chamber 31 to the first liquid supply chamber 13, the first filter 16 provided with the plurality of first liquid supply ports 15 as described above captures air bubbles and foreign matters such as dusts contained in the ink. As shown in FIG. 4, it is preferable that the inner diameter $d_1$ of the first liquid supply port 15 be the inner diameter $d_N$ of the nozzle 21 or smaller ($d_1 \leq d_N$). As a result, the foreign matter larger than the inner diameter $d_N$ of the nozzle 21 causing clogging of the nozzle 21 is captured by the first filter 16, and ejection failure due to the foreign matter of the nozzle 21 can be inhibited.

In addition, in the embodiment, the flow path forming substrate 10 provided with the pressure generation chamber 12 and the like, the vibration plate 50, the piezoelectric element 300, the first filter 16, the protective substrate 30, and a second filter 34 described later in detail are collectively referred to as a piezoelectric device.

On the other hand, a piezoelectric element holding portion 32 is provided in a region of the protective substrate 30 facing the piezoelectric element 300. Since the piezoelectric element 300 is formed in the piezoelectric element holding portion 32, the piezoelectric element 300 is protected in a state hardly affected by the external environment. The piezoelectric element holding portion 32 may be sealed or not sealed.

In addition, a drive circuit holding portion 33 is provided between the piezoelectric element holding portions 32 of the protective substrate 30. The drive circuit holding portion 33 is provided penetrating the protective substrate 30 in the third direction Z which is the thickness direction, and the drive circuit 120 is provided inside thereof.

As such a material of the protective substrate 30, for example, a metal such as stainless steel, nickel (Ni), a silicon single crystal substrate, ceramic materials represented by zirconium oxide ($ZrO_X$) or aluminum oxide ($Al_XO_Y$), glass ceramic materials, oxide such as silicon oxide ($SiO_X$), magnesium oxide (MgO), lanthanum aluminate ($LaAlO_3$), or the like can be used. The protective substrate 30 is preferably formed of a material having substantially the same thermal expansion coefficient as that of the flow path forming substrate 10, and in the embodiment, is formed using a silicon single crystal substrate made of the same material as the flow path forming substrate 10.

In addition, the second filter 34 that covers the opening of the second liquid supply chamber 31 is provided in the opening portion of the second liquid supply chamber 31 on the surface of the protective substrate 30 opposite to the flow path forming substrate 10.

Such a second filter 34 may be formed on the protective substrate 30 by a liquid phase method or a gas phase method, or may be one in which the second filter 34 is attached to the protective substrate 30.

As a material of the second filter 34, a single layer or a laminate of at least one kind of material selected from silicon oxide ($SiO_X$), zirconium oxide ($ZrO_X$), silicon nitride (SiN), titanium oxide ($TiO_X$) can be used. It goes without saying that the material of the second filter is not limited to the above-mentioned material, and the material may be a resin, a metal or the like, or a laminate of a metal or a resin. In a case where a material having low etching resistance to ink is used as the second filter 34, it is preferable to use a protective film having liquid resistance (ink resistance) on the surface. In the embodiment, silicon dioxide ($SiO_2$) is used as the second filter 34. In addition, the second filter 34 is provided continuously over the surface of the protective substrate 30 on the side opposite to the flow path forming substrate 10. Such a second filter 34 may be formed by thermally oxidizing the protective substrate 30 made of monocrystalline silicon, or may be formed by film formation. It goes without saying that the second filter 34 may be attached to the protective substrate 30.

In addition, the protective film 200 is formed on the surface of the second filter 34. The protective film 200 is continuously formed over the surface of the second filter 34, that is, over the surface of the second filter 34 on the protective substrate 30 side, the surface on a case member 40 side, and the inner wall surface of a second liquid supply port 35 described later in detail. By providing the protective film 200 on the second filter 34 in this manner, it is possible to inhibit the second filter 34 from being etched by the ink.

The plurality of second liquid supply ports 35 are provided in such a second filter 34. Each of the second liquid supply ports 35 has an opening smaller than the opening of the second liquid supply chamber 31 on the side opposite to the flow path forming substrate 10, and two or more second liquid supply ports are provided for the second liquid supply chamber 31. Here, the fact that the plurality of second liquid supply ports 35 are provided for the second liquid supply chamber 31 means that two or more second liquid supply ports 35 are provided for one second liquid supply chamber 31. That is, although the plurality of second liquid supply ports 35 are provided in one recording head 1, the device in which one second liquid supply port 35 is provided for one second liquid supply chamber 31 are not included in the "plurality of second liquid supply ports" of the invention.

In addition, on the protective substrate 30, the case member 40 which is the flow path member of the embodiment is fixed. In the embodiment, the case member 40 is bonded onto the protective substrate 30 via an adhesive 44.

A third liquid supply chamber 41 communicating with the second liquid supply chamber 31 of the protective substrate 30 is formed in the case member 40. In the embodiment, the third liquid supply chamber 41 is provided penetrating the case member 40 in the third direction Z which is the lamination direction. An opening of the third liquid supply chamber 41 on the protective substrate 30 side has an opening larger than that of the second liquid supply chamber 31 and a portion of the opening of the third liquid supply chamber 41 on the protective substrate 30 side is sealed with the surface of the protective substrate 30 on the case member 40 side, and in the embodiment, the second filter 34.

The ink from the third liquid supply chamber 41 of the case member 40 as described above is supplied to the second liquid supply chamber 31 via the plurality of second liquid supply ports 35.

By providing the second filter 34 on the protective substrate 30 in this manner, the foreign matter contained in the ink can be captured by the second filter 34 and the foreign matter that cannot be captured by the second filter 34 can be captured by the first filter 16. That is, it is possible to capture the foreign matter in two stages, the second filter 34 and the first filter 16. Therefore, as compared with the case where only one of the first filter 16 and the second filter 34 is provided, it is possible to inhibit clogging of the filter due to the foreign matter. In particular, by providing the second filter 34 between the third liquid supply chamber 41 of the case member 40 and the second liquid supply chamber 31 of the protective substrate 30, the foreign matter captured by the second filter 34 can be retained in the third liquid supply chamber 41 having the comparatively large volume of the case member 40. Therefore, the foreign matter such as air bubbles captured by the second filter 34 is held in the third liquid supply chamber 41, the foreign matters such as air bubbles held in the third liquid supply chamber 41 is floated in a relatively large space, and clogging of the second filter 34 can be inhabited. Incidentally, the ink in the third liquid supply chamber 41 may be circulated between the third liquid supply chamber 41 and the ink supply unit. As a result, the foreign matter captured by the second filter 34 is returned to the side of the ink supply unit so that clogging of the second filter 34 by the foreign matter can be inhibited.

In addition, the inner diameter $d_2$ of the second liquid supply port 35 is the inner diameter $d_1$ or larger of the first liquid supply port 15 ($d_2 \geq d_1$). The inner diameter $d_2$ of the second liquid supply port 35 is the inner diameter $d_1$ or larger of the first liquid supply port 15 in this manner, so that a larger foreign matter is captured by the second filter 34, and the foreign matter smaller than the second liquid supply port 35 which cannot be captured by the second filter 34 can be captured by the first filter 16. Therefore, the clogging of the foreign matter of the nozzle 21 can be further inhibited. In addition, since the relatively large foreign matter can be captured by the second filter 34, the first liquid supply port 15 of the first filter 16 is inhibited from being covered with the large foreign matter and the clogging of the first filter 16 can be reduced.

It is preferable that the inner diameter $d_2$ of the second liquid supply port 35 be the inner diameter $d_N$ of the nozzle 21 or smaller ($d_2 \leq d_N$). As a result, the foreign matter larger than the inner diameter $d_N$ of the nozzle 21 and causing clogging of the nozzle 21 is captured by the second filter 34, so that ejection failure due to the foreign matter of the nozzle 21 can be inhibited.

In addition, by providing the first filter 16 and the second filter 34 on both sides of the protective substrate 30 in the third direction Z, it is possible to provide two first filters 16 and two second filters 34 at positions close to the nozzle 21. Therefore, even if the foreign matter is generated due to falling off of the adhesive or the like in the middle of the flow path, the foreign matter can be captured by the two first filters 16 and two second filter 34, and it is possible to effectively inhibit occurrence of ejection failure due to clogging of the nozzle 21 due to foreign matter. Incidentally, for example, if a filter is provided at a position away from the nozzle 21 on the upstream side of the flow path, a plurality of adhesives are present on the downstream of the nozzle 21 side from the filter. When the foreign matter is generated due to a portion of the adhesive falling off, there is a possibility that the foreign matter cannot be captured by the filter and clogging of the nozzle 21 may occur.

Furthermore, a compliance substrate 45 including a sealing film 46 and a fixing plate 47 is bonded to a surface of the case member 40 opposite to the protective substrate 30 on which the third liquid supply chamber 41 is open. The sealing film 46 is made of a material having low rigidity and flexibility (for example, polyphenylene sulfide (PPS) film having a thickness of 6 μm), and one surface of the third liquid supply chamber 41 is sealed by the sealing film 46. In addition, the fixing plate 47 is formed of a hard material such as metal. Since a region of the fixing plate 47 facing the third liquid supply chamber 41 is an opening 48 completely removed in the thickness direction, one surface of the third liquid supply chamber 41 is a compliance portion 49 sealed only with the sealing film 46 having the flexibility.

In addition, the compliance substrate 45 is provided with an ink introduction port 42 penetrating in the thickness direction, and ink is supplied from an external ink supply unit (not shown) to the third liquid supply chamber 41 via the ink introduction port 42. That is, in the recording head 1 of the embodiment, after ink is taken in from the external ink supply unit (not shown) via the ink introduction port 42, and the interior thereof is filled with ink from the third liquid supply chamber 41 to the nozzle 21, a voltage is applied between each of the first electrode 60 and the second electrode 80 corresponding to the pressure generation chamber 12 according to the recording signal from the drive circuit 120, and the piezoelectric element 300 and the vibration plate 50 are bent and deformed. Therefore, the pressure in each pressure generation chamber 12 increases, and ink is discharged from the nozzle 21.

As described above, there is provided the nozzle 21 that ejects a liquid, the flow path forming substrate 10 on which the pressure generation chamber 12 communicating with the nozzle 21 and the first liquid supply chamber 13 communicating with the pressure generation chamber 12 are formed, the vibration plate 50 that is formed on one surface side of the flow path forming substrate 10, the piezoelectric element 300 that is provided on the vibration plate 50 at a position corresponding to the first pressure generation chamber 12, the first filter 16 that is provided on the one surface side of the flow path forming substrate 10 and in which the plurality of first liquid supply ports 15 communicating with the first liquid supply chamber 13 are formed, the protective substrate 30 that is provided on the one surface side of the flow path forming substrate 10 and provided with the second liquid supply chamber 31 communicating with the first liquid supply chamber 13 via the first liquid supply port 15, and the second filter 34 that is provided on an upstream side of the first filter 16 and provided with the plurality of second liquid supply ports 35, in which an inner diameter $d_2$ of the second liquid supply port 35 is an inner diameter $d_1$ or larger of the first liquid supply port 15.

By providing the first filter 16 and the second filter 34 in this manner, it is possible to capture the foreign matter with two-stage filters. Therefore, as compared with the case where only one of the first filter 16 and the second filter 34 is provided, it is possible to inhibit clogging of the filter due to the foreign matter.

In addition, since the inner diameter $d_2$ of the second liquid supply port 35 of the second filter 34 is the inner diameter $d_1$ or larger of the first liquid supply port 15 of the first filter 16, a larger foreign matter is captured by the second filter 34, and the foreign matter smaller than the second liquid supply port 35 which cannot be captured by the second filter 34 can be captured by the first filter 16. Therefore, since the relatively large foreign matter can be captured by the second filter 34, the first liquid supply port 15 of the first filter 16 is inhibited from being covered with the large foreign matter and the clogging of the first filter 16 can be reduced.

In addition, in the embodiment, it is preferable that the first filter 16 be formed by at least a portion of the vibration plate 50. According to this configuration, at least a portion of the first filter 16 can be simultaneously formed by the step of forming the vibration plate 50, at least a portion of the step of forming the first filter 16 can be omitted to reduce the cost.

In addition, in the embodiment, it is preferable that the inner diameter $d_1$ of the first liquid supply port 15 be the inner diameter $d_N$ of the nozzle 21 or smaller. According to this configuration, the foreign matter larger than the inner diameter $d_N$ of the nozzle 21 is captured by the first filter 16, and occurrence of ejection failure due to clogging of the nozzle 21 by the foreign matter can be inhibited. Similarly, it is preferable that the inner diameter $d_2$ of the second liquid supply port 35 be the inner diameter $d_N$ of the nozzle 21 or smaller. As a result, the foreign matter larger than the inner diameter $d_N$ of the nozzle 21 and causing clogging of the nozzle 21 is captured by the second filter 34, and ejection failure due to the foreign matter of the nozzle 21 can be further inhibited. It goes without saying that the inner diameter $d_2$ of the second liquid supply port 35 may be larger than the inner diameter $d_N$ of the nozzle 21.

In addition, in the embodiment, the second liquid supply chamber 31 is provided so as to penetrate through the protective substrate 30 in the third direction Z which is a lamination direction of the protective substrate 30 and the flow path forming substrate 10, and the second filter 34 is preferably provided in the opening of the second liquid supply chamber 31 on the side of the protective substrate 30 opposite to the flow path forming substrate 10. According to this configuration, since the second filter 34 can be disposed as close as possible to the first filter 16 by providing the second filter 34 at the opening of the second liquid supply chamber 31, a flow path length between the second filter 34 and the first filter 16 is shortened, and the foreign matter is hardly generated between the second filter 34 and the first filter 16. Even if the foreign matter occurs on the upstream side, the foreign matter can be captured by the second filter 34 and clogging of the first filter 16 due to the foreign matter can be inhibited. Incidentally, if the second filter 34 is disposed on the further upstream side, the flow path length between the second filter 34 and the first filter 16 is longer, the foreign matter is likely to be generated in the middle compared with the case where the flow path length is short, and there is a possibility that clogging of the first filter 16 may be generated by the foreign matter.

In the embodiment, the second filter 34 is provided in the opening of the second liquid supply chamber 31 on the side opposite to the flow path forming substrate 10 of the protective substrate 30, but the position of the second filter 34 is not particularly limited as long as the second filter 34 is on the upstream side of the first filter 16. For example, the second filter 34 may be provided in the opening portion of the third liquid supply chamber 41 on the surface of the case member 40, which is the flow path member, on the side opposite to the protective substrate 30.

In addition, in the embodiment, it is preferable that the first liquid supply chamber 13 be independently provided in each of the pressure generation chambers 12. According to this configuration, by providing the first liquid supply chamber 13 independently in each of the pressure generation chambers 12, it is possible to impart a flow path resistance of ink flowing into the pressure generation chamber 12 by the first liquid supply port 15 of the first filter 16. Therefore, it is possible to shorten the ink supply path 14 and to inhibit the ink supply path 14 from being provided on the flow path forming substrate 10, and the size of the flow path forming substrate 10 can be reduced. In a case where the flow path resistance is imparted at the first liquid supply port 15 of the first filter 16, an opening ratio of the first liquid supply port 15 (area ratio to the opening area of the first liquid supply chamber 13 on the protective substrate 30 side) may be appropriately adjusted.

The first liquid supply chamber 13 may communicate with the plurality of pressure generation chambers 12 in common. Incidentally, even in a case where the first liquid supply chamber 13 is independently provided in each of the pressure generation chambers 12, since the pressure change in the pressure generation chamber 12 is inhibited from affecting the upstream side by the ink supply path 14 by providing the ink supply path 14 in the flow path forming substrate 10, breakage due to deformation due to pressure change of the first filter 16 can be inhibited.

Here, a method of manufacturing the recording head of the embodiment will be described with reference to FIGS. 5 to 9. FIGS. 5 to 9 are cross-sectional views showing the method of manufacturing the recording head.

Figure 5:
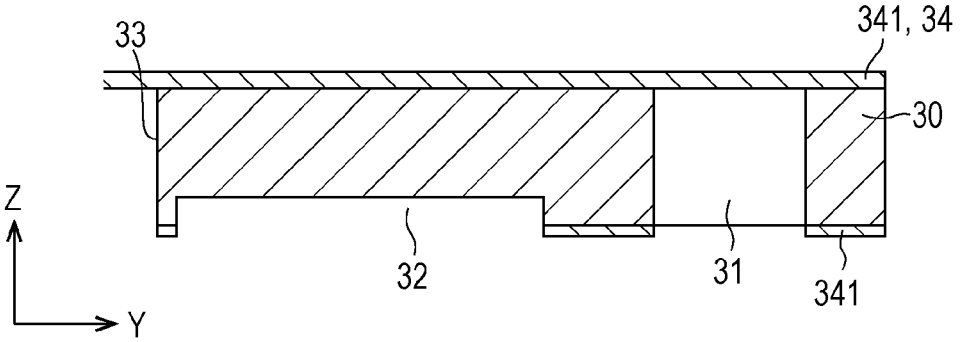
FIG. 5 is a view showing a method of manufacturing the recording head according to Embodiment 1 of the invention.

As shown in FIG. 5, a silicon oxide film 341 to be the second filter 34 is formed over the entire surface of the protective substrate 30 made of a silicon single crystal substrate, and the protective substrate 30 is etched using the silicon oxide film 341 on one side as a mask to form the second liquid supply chamber 31, the piezoelectric element holding portion 32, and the drive circuit holding portion 33. The piezoelectric element holding portion 32 can be formed by wet etching the protective substrate 30 with an alkaline solution such as KOH using the silicon oxide film 341 as a mask. In addition, the second liquid supply chamber 31 and the drive circuit holding portion 33 can be formed by dry etching the protective substrate 30 and switching to wet etching with a portion of the protective substrate 30 remaining on the bottom surface. As described above, when forming the second liquid supply chamber 31, the silicon oxide film 341 remains in the opening portion of the second liquid supply chamber 31 without being etched so as to block the second liquid supply chamber 31 by switching from dry etching to wet etching. In the embodiment, the silicon oxide film 341 which blocks the opening of the second liquid supply chamber 31 serves as the second filter 34.

In the embodiment, the second liquid supply chamber 31 is formed by using dry etching and wet etching, but it is not limited thereto, and the second liquid supply chamber 31 may be formed by only wet etching.

In addition, when forming the drive circuit holding portion 33 by etching, the silicon oxide film 341 and the protective substrate 30 may be removed by, for example, dry etching.

Figure 6:
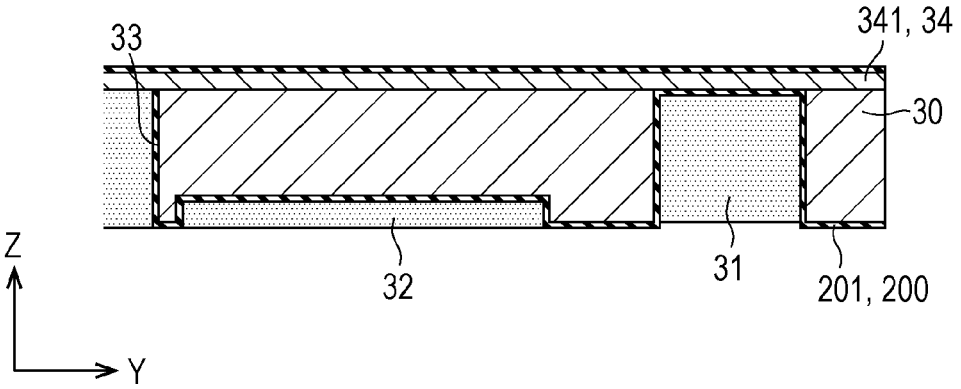
FIG. 6 is a view showing the method of manufacturing the recording head according to Embodiment 1 of the invention.

Next, as shown in FIG. 6, a first protective film 201 serving as the protective film 200 is formed over the entire surface of the protective substrate 30 on which the second liquid supply chamber 31, the piezoelectric element holding portion 32, and the drive circuit holding portion 33 are formed. In the embodiment, the first protective film 201 can be formed by a gas phase method such as a CVD method, for example.

Figure 7:
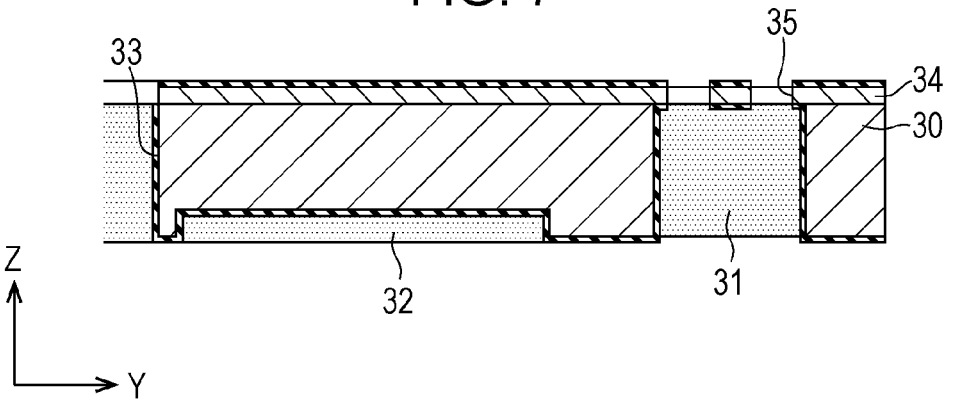
FIG. 7 is a view showing the method of manufacturing the recording head according to Embodiment 1 of the invention.

Next, as shown in FIG. 7, the silicon oxide film 341 remaining in the opening portion of the second liquid supply chamber 31 is dry-etched to form the second liquid supply port 35. As a result, the silicon oxide film 341 becomes the second filter 34 in which the second liquid supply port 35 is formed. In the case where the silicon oxide film 341 is formed so as to block the opening of the drive circuit holding portion 33, the silicon oxide film 341 which blocks the opening of the drive circuit holding portion 33 may be removed simultaneously with the formation of the second liquid supply port 35.

Figure 8:
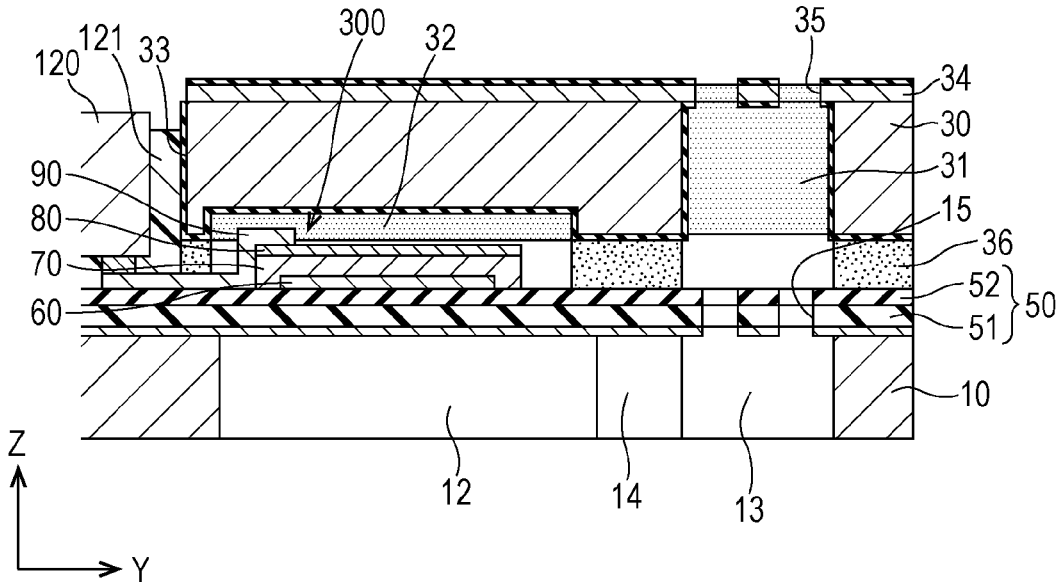
FIG. 8 is a view showing the method of manufacturing the recording head according to Embodiment 1 of the invention.

Next, as shown in FIG. 8, the flow path forming substrate 10 on which the vibration plate 50, the piezoelectric element 300, the lead electrode 90, and the like are formed is bonded to the protective substrate 30. In the embodiment, the protective substrate 30 is adhered to the flow path forming substrate 10 via the adhesive 36. Before or after bonding the flow path forming substrate 10 to the protective substrate 30, the pressure generation chamber 12, the first liquid supply chamber 13, the ink supply path 14, and the first liquid supply port 15 are formed in the flow path forming substrate 10. In addition, the drive circuit 120 is preferably mounted after the flow path forming substrate 10 and the protective substrate 30 are bonded to each other and the pressure generation chamber 12, the first liquid supply chamber 13, the ink supply path 14, and the first liquid supply port 15 are formed in the flow path forming substrate 10. This is because the drive circuit 120 is not wasted due to the failure of other step when the drive circuit 120 is mounted as much as possible in the latter step since the drive circuit 120 is expensive, and the yield can be improved to reduce the cost.

Figure 9:
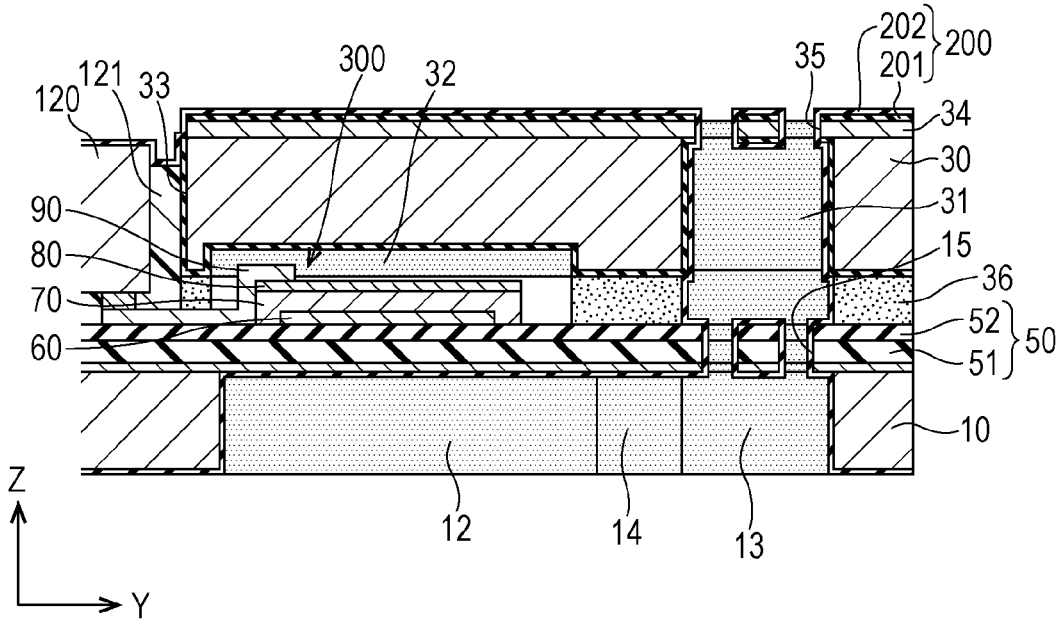
FIG. 9 is a view showing the method of manufacturing the recording head according to Embodiment 1 of the invention.

Next, as shown in FIG. 9, a second protective film 202 to be the protective film 200 is formed on the bonded body in which the flow path forming substrate 10 and the protective substrate 30 are bonded to each other. Since the second protective film 202 is formed by a gas phase method such as a CVD method or the like, the second protective film 202 is formed over the entire surface of the bonded body of the flow path forming substrate 10 and the protective substrate 30. As a result, the protective film 200 having the first protective film 201 and the second protective film 202 can be formed over the inner wall surface of the flow path in contact with the ink. In particular, since the protective film 200 can be formed on the inner wall surface of the first liquid supply port 15 of the first filter 16 and the inner wall surface of the second liquid supply port 35 of the second filter 34, the first filter 16 and the second filter 34 can be inhibited from being etched with ink. In addition, by providing the protective film 200 on the first filter 16 and the second filter 34, the rigidity and toughness of the first filter 16 and the second filter 34 are improved, and breakage of the first filter 16 and the second filter 34 can be inhibited.

Thereafter, the nozzle plate 20 is bonded to the flow path forming substrate 10, and the case member 40 and the compliance substrate 45 are bonded to the protective substrate 30, so that the recording head 1 is obtained.

As described above, there is provided a method of manufacturing the ink jet type recording head including the nozzle 21 that ejects a liquid, the flow path forming substrate 10 on which the pressure generation chamber 12 communicating with the nozzle 21 and the first liquid supply chamber 13 communicating with the pressure generation chamber 12 are formed, the vibration plate 50 that is formed on one surface side of the flow path forming substrate 10, the piezoelectric element 300 that is provided on the vibration plate 50 at a position corresponding to the first pressure generation chamber 12, the first filter 16 that is provided on the one surface side of the flow path forming substrate 10 and in which the plurality of first liquid supply ports 15 communicating with the first liquid supply chamber 13 are formed, the protective substrate 30 that is provided on the one surface side of the flow path forming substrate 10 and provided with the second liquid supply chamber 31 communicating with the first liquid supply chamber 13 via the first liquid supply port 15, and the second filter 34 that is provided on a surface of the protective substrate 30 opposite to the flow path forming substrate 10 and in which a plurality of second liquid supply ports 35 communicating with the second liquid supply chamber 31 are formed, the method including forming the second liquid supply chamber 31 and the second filter 34 on the protective substrate 30, forming the first protective film 201 having liquid resistance on an inner wall surface of the second liquid supply chamber 31 of the protective substrate 30 and the second filter 34 by the gas phase method, bonding the protective substrate 30 and the flow path forming substrate 10 and forming the pressure generation chamber 12, the first liquid supply chamber 13, and the first filter 16 on the flow path forming substrate 10, and forming the second protective film 202 having liquid resistance on an inner wall of the pressure generation chamber 12, the first liquid supply chamber 13, and the second liquid supply chamber 31, the first filter 16, and the second filter 34 by the gas phase method in the bonded body in which the protective substrate 30 and the flow path forming substrate 10 are bonded to each other.

By performing the step of forming the first protective film 201 and the step of forming the second protective film 202 before and after bonding the protective substrate 30 and the flow path forming substrate 10 in this manner, so that the protective film 200 can be continuously formed over the inner wall surface of the flow path, the surfaces of the first filter 16 and the second filter 34. Therefore, it is possible to reliably protect the inner wall surface of the flow path, the first filter 16, and the second filter 34 by the protective film 200.

Embodiment 2

Figure 10:
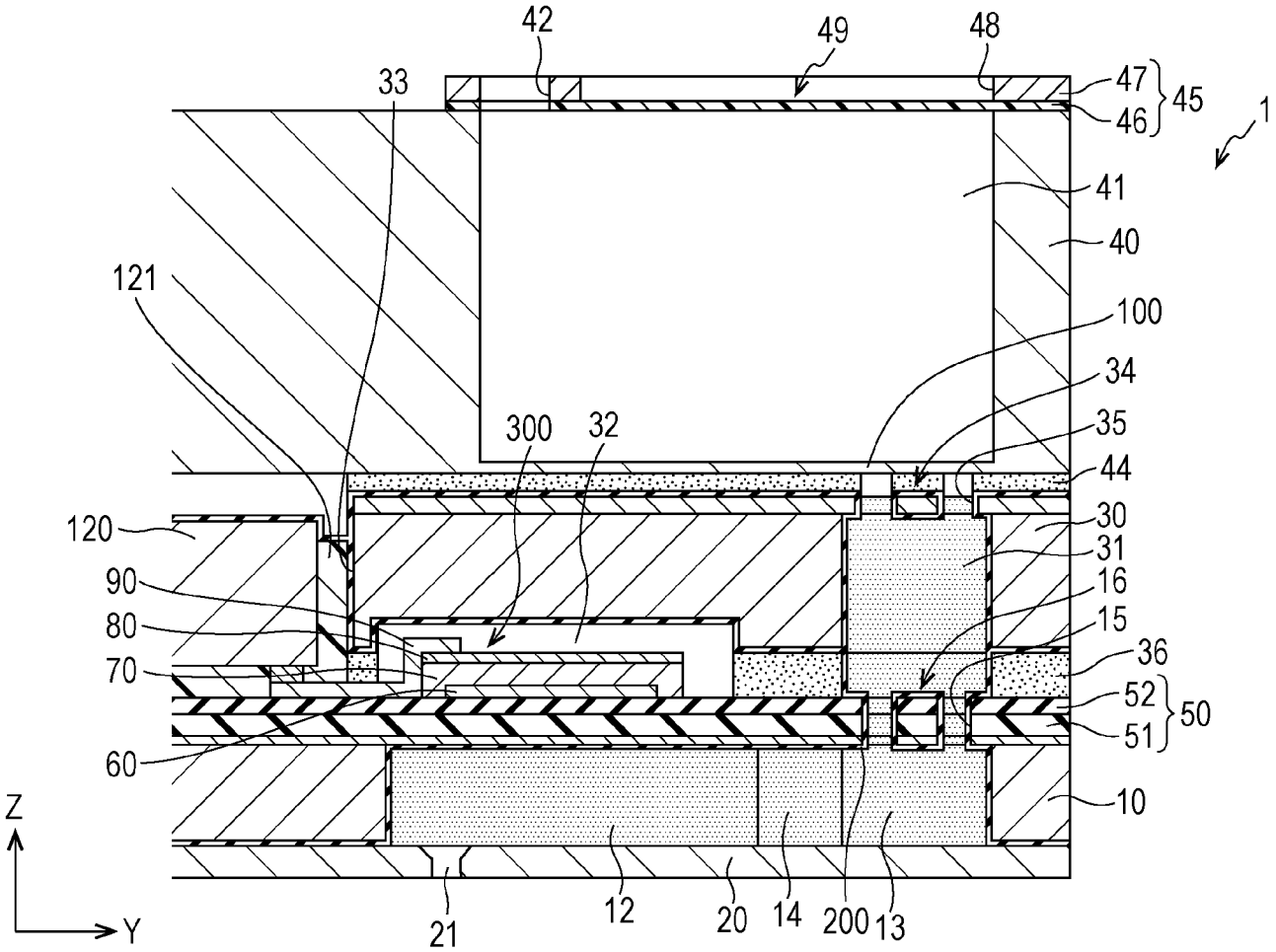
FIG. 10 is a cross-sectional view of a main part of a recording head according to Embodiment 2 of the invention.
Figure 11:
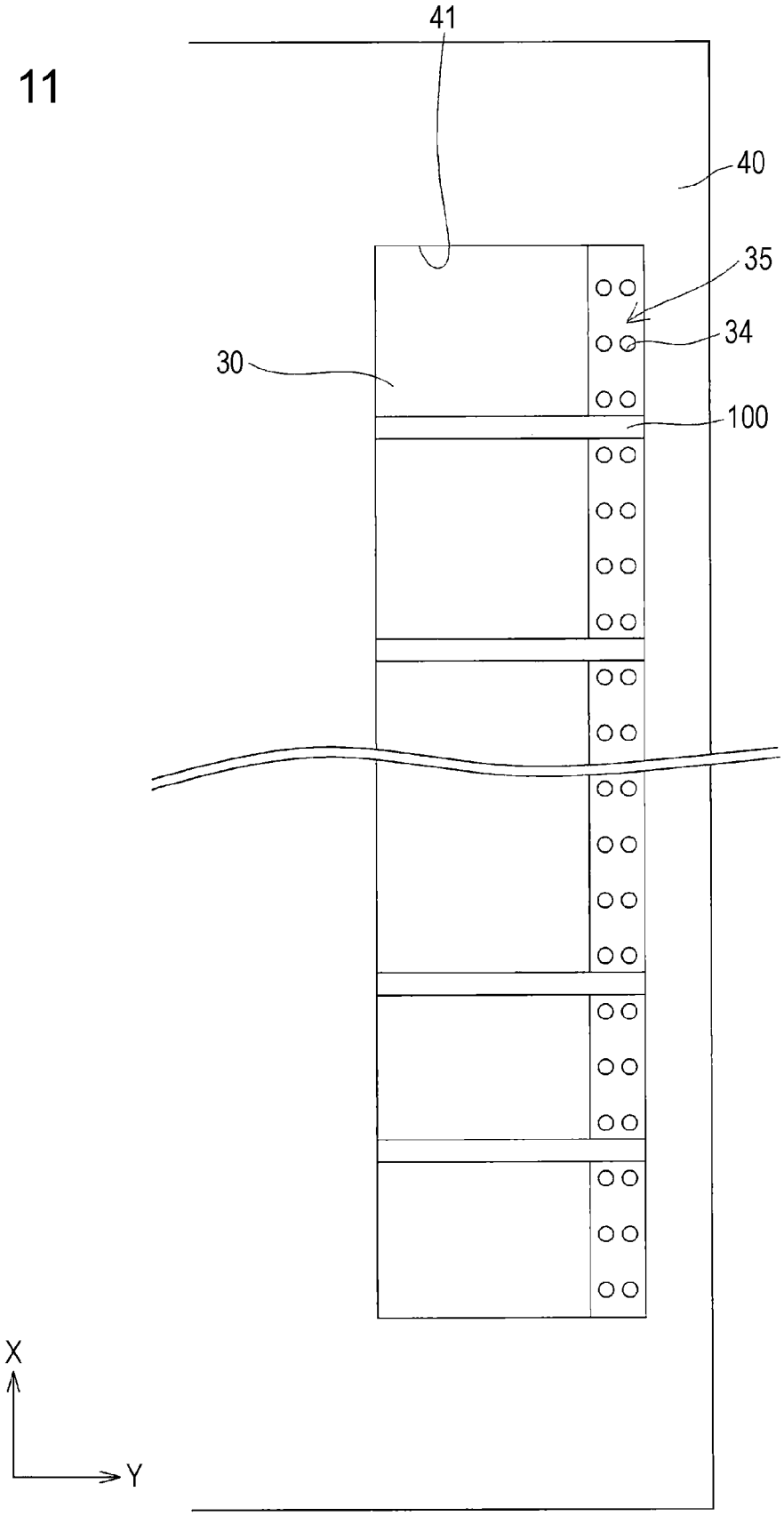
FIG. 11 is a plan view of the main part of the recording head according to Embodiment 2 of the invention.

FIG. 10 is a cross-sectional view of a main part of an ink jet type recording head which is an example of a liquid ejecting head according to Embodiment 2 of the invention. FIG. 11 is a plan view of a main part of a case member of the ink jet type recording head. The same reference numerals are given to members similar to those in the above-described embodiment, and redundant explanations are omitted.

As shown in the drawing, the case member 40, which is the flow path member of the embodiment, is provided with a beam portion 100 provided on the case member 40 side of the second filter 34 and traversing the opening of the second liquid supply chamber 31 on the case member 40 side.

The beam portion 100 may be formed integrally with the case member 40 or may be provided separately from the case member 40. The beam portion 100 of the embodiment is provided integrally with the case member 40. Incidentally, the beam portion 100 integrated with the case member 40 can be simultaneously formed when the case member 40 is molded with resin, and can be formed at low cost. In addition, in a case where the beam portion 100 is provided separately from the case member 40, the material and shape of the case member 40 are not limited to provide the beam portion 100, and it is possible to easily design and manufacture the case member 40 and the beam portion 100. Incidentally, in a case where the beam portion 100 is provided separately from the case member 40, a spacer may be provided between the case member 40 and the protective substrate 30, and the beam portion 100 may be provided on the spacer.

As shown in FIG. 11, it is preferable that such a beam portion 100 be provided so as not to block the second liquid supply port 35 of the second filter 34. In other words, the second liquid supply port 35 may not be provided at a position covered by the beam portion 100 of the second filter 34. It goes without saying that a portion of the beam portion 100 may block a portion of the second liquid supply port 35.

In addition, in the embodiment, as shown in FIG. 11, a plurality of beam portions 100 traversing in the second direction Y with respect to the opening of the second liquid supply chamber 31 on the case member 40 side are provided at predetermined intervals in the first direction X. The shape of the beam portion 100 is not particularly limited, and the beam portion 100 may be disposed in a direction traversing with respect to the opening of the second liquid supply chamber 31 on the case member 40 side in the first direction X, for example. In addition, the beam portion 100 may be provided in a grid pattern with respect to the opening of the second liquid supply chamber 31.

By providing the beam portion 100 on the surface of the second filter 34 on the case member 40 side in this manner, the surface of the second filter 34 on the case member 40 side is supported by the beam portion 100. Therefore, since deformation of the second filter 34, particularly deformation toward the case member 40 side, is inhibited by the beam portion 100, breakage such as cracks due to deformation of the second filter 34 can be inhibited.

In addition, in the embodiment, the beam portion 100 and the second filter 34 are bonded by the adhesive 44 adhering the case member 40 and the protective substrate 30. Therefore, deformation of the second filter 34 toward the second liquid supply chamber 31 side can be inhibited by the beam portion 100. As a result, breakage due to deformation of the second filter 34 can be more reliably inhibited. In the embodiment, the beam portion 100 and the second filter 34 are bonded with the adhesive 44, but it is not particularly limited thereto, and the beam portion 100 and the second filter 34 may not be bonded to each other. However, in a case where the beam portion 100 and the second filter 34 are not bonded to each other, deformation of the second filter 34 toward the second liquid supply chamber 31 side cannot be inhibited by the beam portion 100.

In addition, in the embodiment, the beam portion 100 is provided on the case member 40 side on the upstream side of the second filter 34, but it is not particularly limited thereto, and the beam portion 100 may be provided on the flow path forming substrate 10 side which is the downstream side of the second filter 34. In addition, the beam portion 100 may be provided on both the upstream side and the downstream side of the second filter 34.

As described above, the recording head 1 of the embodiment is provided with the case member 40 which is the flow path member having the third liquid supply chamber 41 communicating with the second liquid supply chamber 31 via the second liquid supply port 35 on the surface of the protective substrate 30 opposite to the flow path forming substrate 10, and the case member 40 has the beam portion 100 that supports the surface of the second filter 34 on the case member 40 side.

By providing the beam portion 100 on the surface of the second filter 34 on the case member 40 side in this manner, the beam portion 100 can support the surface of the second filter 34 on the case member 40 side. Therefore, deformation of the second filter 34, particularly deformation toward the case member 40 side, can be inhibited by the beam portion 100, and breakage such as cracks due to deformation of the second filter 34 can be inhibited.

In addition, in the embodiment, since the beam portion 100 and the second filter 34 are bonded to each other, deformation of the second filter 34 toward the second liquid supply chamber 31 side can be inhibited by the beam portion 100, and breakage of the second filter 34 due to deformation can be further inhibited.

Embodiment 3

Figure 12:
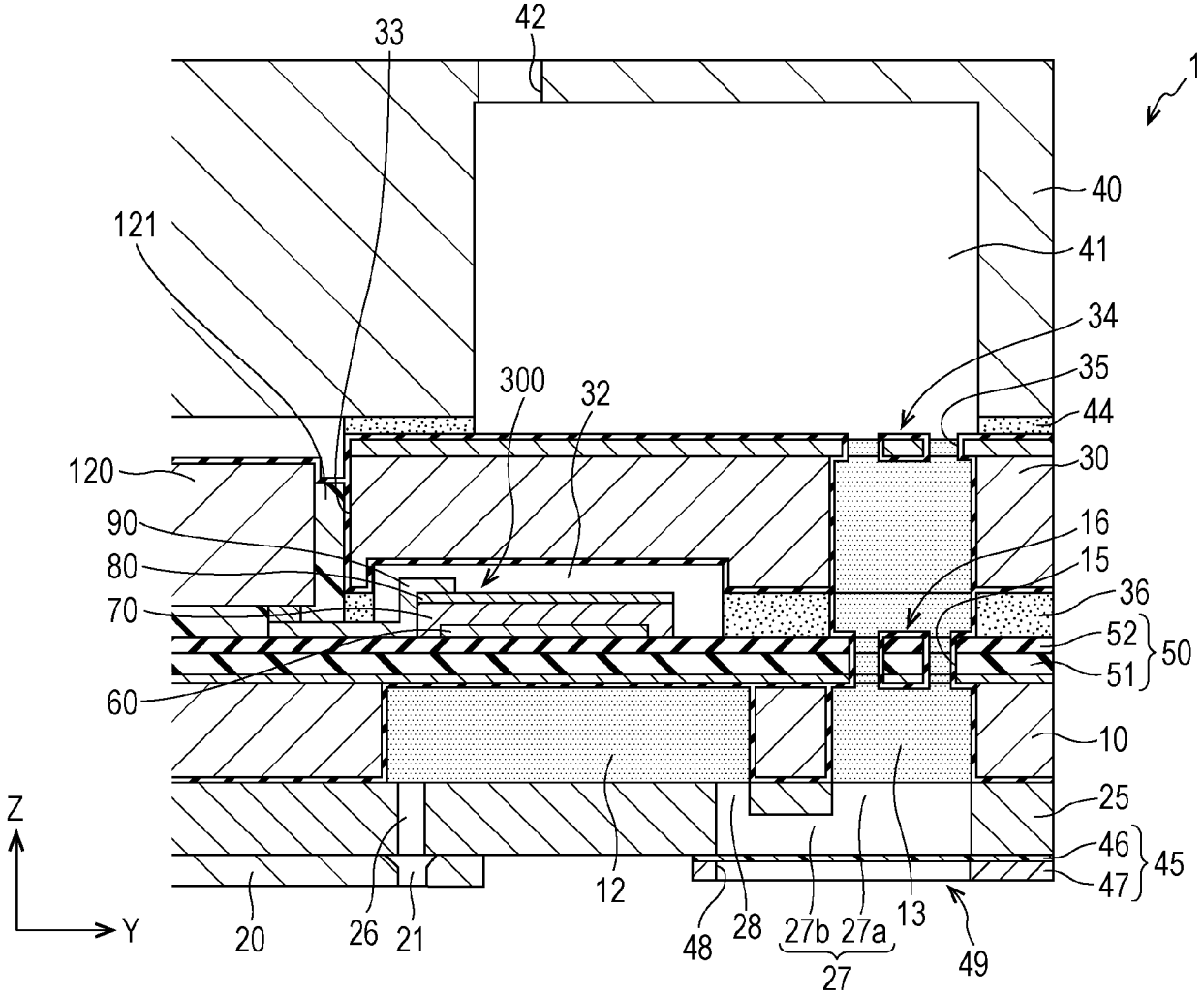
FIG. 12 is a cross-sectional view of a main part of a recording head according to Embodiment 3 of the invention.

FIG. 12 is a cross-sectional view of an ink jet type recording head which is an example of a liquid ejecting head according to Embodiment 3 of the invention. The same reference numerals are given to members similar to those in the above-described embodiment, and redundant explanations are omitted.

As shown in FIG. 12, the pressure generation chamber 12 and the first liquid supply chamber 13 are formed in the flow path forming substrate 10 of an ink jet type recording head which is an example of a liquid ejecting head of the embodiment.

The first liquid supply chamber 13 communicates with the plurality of pressure generation chambers 12 in common, and is provided continuously in the first direction X where the pressure generation chambers 12 are disposed in parallel. In the embodiment, the first liquid supply chamber 13 is communicated with the plurality of pressure generation chambers 12 in common, but it is not limited thereto, and the first liquid supply chamber 13 may be provided independently for each pressure generation chamber 12.

In addition, in the flow path forming substrate 10, the ink supply path 14 of Embodiment 1 described above is not formed, and the first liquid supply chamber 13 and the pressure generation chamber 12 are not directly communicated with each other but are partitioned via a wall formed on a portion of the flow path forming substrate 10.

On the side of the flow path forming substrate 10 opposite to the protective substrate 30, a communication plate 25 and the nozzle plate 20 are sequentially laminated.

The communication plate 25 is provided with a nozzle communication path 26 that communicates the pressure generation chamber 12 and the nozzle 21. That is, the pressure generation chamber 12 communicates with the nozzle 21 via the nozzle communication path 26. As described above, by providing the communication plate 25 and the nozzle communication path 26, the nozzle 21 of the nozzle plate 20 and the pressure generation chamber 12 can be disposed apart from each other, so that the ink in the pressure generation chamber 12 is unlikely to be affected by thickening due to evaporation of moisture in the ink generated in the ink near the nozzle 21. In addition, since the nozzle plate 20 need only cover the opening of the nozzle communication path 26, the area of the nozzle plate 20 can be made relatively small, and the cost can be reduced.

In addition, the communication plate 25 is provided with a communication portion 27 communicating with the first liquid supply chamber 13 of the flow path forming substrate 10. The communication portion 27 has a first communication portion 27*a* and a second communication portion 27*b*. The first communication portion 27*a* is provided so as to penetrate the communication plate 25 in the third direction Z. In addition, the second communication portion 27*b* is opened to the nozzle plate 20 side of the communication plate 25 and provided at a depth up to the middle of the thickness without penetrating the communication plate 25, and one end thereof communicates with the first communication portion 27*a*. In the embodiment, the first communication portion 27*a* and the second communication portion 27*b* as described above are provided in common to the plurality of pressure generation chambers 12. It goes without saying that the first communication portion 27*a* and the second communication portion 27*b* may be independently provided for each pressure generation chamber 12. In addition, the first communication portion 27*a* may be provided in common to the plurality of pressure generation chambers 12, and the second communication portion 27*b* may be provided independently for each pressure generation chamber 12.

Furthermore, the communication plate 25 is provided with an ink supply path 28 that penetrates the communication plate 25 in the third direction Z and communicates the other end of the second communication portion 27*b* and the pressure generation chamber 12. The ink supply path 28 is independently provided in each of the pressure generation chambers 12, and keeps the flow path resistance of the ink flowing into the pressure generation chamber 12 constant.

In addition, the compliance substrate 45 is provided on the surface of the communication plate 25 on the nozzle plate 20 side where the communication portion 27 is open. The compliance substrate 45 seals the opening of the communication portion 27 on the nozzle plate 20 side. Such a compliance substrate 45 includes a flexible sealing film 46 and a fixing plate 47 made of a hard material such as metal, similar to the above-described embodiment. Since the region of the fixing plate 47 facing the third liquid supply chamber 41 is the opening 48 completely removed in the thickness direction, one surface of the communication portion 27 is the compliance portion 49 which is a flexible portion sealed only with the flexible sealing film 46.

In addition, the first filter 16 including at least a portion of the vibration plate 50 is provided in an opening portion of the flow path forming substrate 10 on the protective substrate 30 side of the first liquid supply chamber 13. The first filter 16 has the first liquid supply port 15, similar to the above-described embodiment.

In addition, the second filter 34 provided with the second liquid supply port 35 is provided in an opening portion of the protective substrate 30 on the side opposite to the flow path forming substrate 10 of the second liquid supply chamber 31.

As described above, in the recording head 1 of the embodiment, by providing the compliance portion 49 as a flexible portion at a position close to the pressure generation chamber 12 on the upstream side of the pressure generation chamber 12, in the embodiment, between the pressure generation chamber 12 and the first filter 16, the pressure fluctuation toward the upstream side from the pressure generation chamber 12 at the time of ejecting ink can be absorbed by deformation of the compliance portion 49. Therefore, the compliance portion 49 can absorb the pressure fluctuating toward the upstream side from the pressure generation chamber 12 in a short time. Therefore, it is possible to shorten the drive cycle for driving the piezoelectric element 300, to continuously eject ink droplets in a short time, and to improve the printing speed. In addition, in the embodiment, the pressure fluctuation toward the upstream side from the pressure generation chamber 12 at the time of ink ejection can be previously absorbed by the compliance portion 49 before the first filter 16. Therefore, the pressure fluctuation toward the upstream from the pressure generation chamber 12 at the time of ejecting ink is unlikely to be applied to the first filter 16, the first filter 16 is unlikely to be deformed, and breakage due to deformation is unlikely to occur.

In the embodiment, the compliance portion 49 is provided between the pressure generation chamber 12 and the first filter 16, but it is not limited thereto, and the compliance portion 49 may be provided on the upstream side of the second filter 34, similar to Embodiment 1 described above. In addition, both of the compliance portion 49 of the embodiment and the compliance portion 49 of Embodiment 1 described above may be provided.

In addition, although not specifically shown, in a case where a material having low liquid resistance (ink resistance) is used as the communication plate 25, it is preferable to provide the protective film 200 on the inner wall of the flow path such as the nozzle communication path 26 and the communication portion 27 of the communication plate 25.

As described above, in the embodiment, the compliance portion 49 having flexibility is provided on the wall surface of the flow path between the first filter 16 and the pressure generation chamber 12.

As described above, by providing the compliance portion 49 between the first filter 16 and the pressure generation chamber 12, the pressure fluctuating toward the upstream side from the pressure generation chamber 12 when ink droplets are ejected can be absorbed by deformation of the compliance portion 49. Therefore, the pressure fluctuation is unlikely to be transmitted to the first filter 16, and breakage due to deformation of the first filter 16 can be inhibited. In addition, by providing the compliance portion 49 at a position close to the pressure generation chamber 12, it is possible to absorb the pressure fluctuating toward the upstream side from the pressure generation chamber 12 in a short time. It is possible to shorten the drive cycle for driving the piezoelectric element 300, to continuously eject ink droplets in a short time, and to improve the printing speed.

Other Embodiment

Hereinbefore, although each of the embodiments of the invention is described, the basic configuration of the invention is not limited to the above-described embodiments.

In Embodiments 1 and 2 described above, the ink supply path 14 is provided in the flow path forming substrate 10, but it is not limited thereto, and the ink supply path 14 may not be provided. For example, only the first liquid supply port 15 of the first filter 16 may function as an ink supply path. The second liquid supply chamber 31 may be independently provided in each of the pressure generation chambers 12, and the first liquid supply port 15 of the first filter 16, the second liquid supply port 35 of the second filter 34, and the second liquid supply chamber 31 between the first filter 16 and the second filter 34 may function as ink supply paths for keeping the flow path resistance of the ink flowing into the pressure generation chamber 12 constant. By not providing the ink supply path 14 in this manner, the flow path forming substrate 10 can be downsized and the recording head 1 can be downsized. In a case where a flow path resistance is applied to the first liquid supply port 15 and the second liquid supply port 35 of the first filter 16, the opening ratio of the first liquid supply port 15 and the second liquid supply port 35 may be appropriately adjusted.

In addition, in each of the embodiments described above, a third filter may be provided on the upstream side of the second filter 34. As the third filter, for example, the third filter can be provided in an opening on the side opposite to the protective substrate 30 of the third liquid supply chamber 41 of the case member 40 which is the flow path member. It goes without saying that the number of filters is not limited to three, and four or more filters may be provided. In addition, a filter may be provided on a member or the like on the upstream side of the flow path member. In a case where a multistage filter is provided, it is preferable that the opening of the filter gradually decrease from the upstream side to the downstream side. As a result, it is possible to capture a relatively large foreign matter on the upstream side, to capture a relatively small foreign matter on the downstream side, and to efficiently capture the foreign matters of different sizes with a plurality of filters.

In addition, in each of the embodiments described above, the configuration in which the vibration plate 50 is formed on the flow path forming substrate 10 is exemplified, but it is not particularly limited thereto, and the vibration plate 50 may be attached to the flow path forming substrate 10.

Furthermore, each of the above-described embodiments is described using the thin film type piezoelectric element 300 as a drive element that causes a pressure change in the pressure generation chamber 12, but the invention is not limited thereto. For example, it is possible to use a thick film type piezoelectric element formed by a method such as attaching a green sheet or the like, or a longitudinal vibration type piezoelectric element which alternately laminates a piezoelectric material and an electrode forming material to expand and contract in the axial direction. In addition, as the drive element, it is possible to use a device in which a heat generation element is disposed in the pressure generation chamber to discharge the liquid droplets from the nozzle by bubbles generated by heat generation of the heat generation element, or a so-called electrostatic actuator which generates static electricity between the vibration plate and the electrode and deforms the vibration plate by the electrostatic force to discharge the liquid droplets from the nozzle opening.

Figure 13:
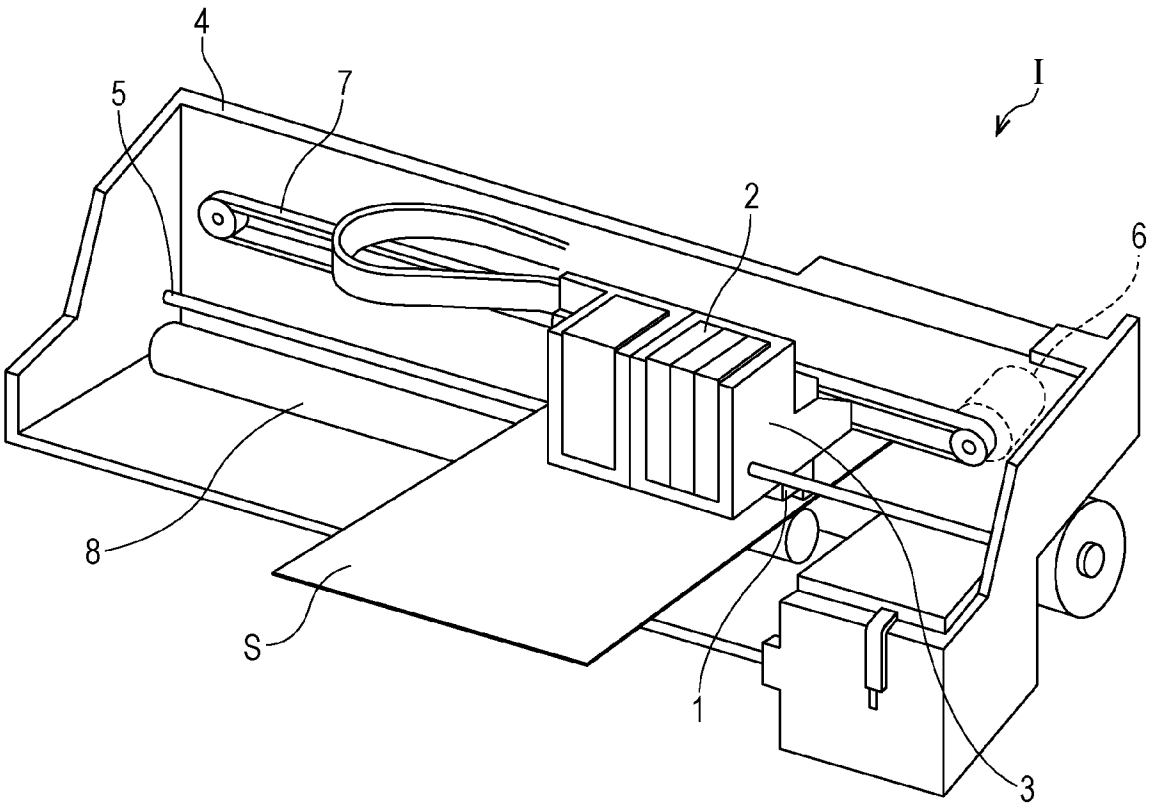
FIG. 13 is a view showing a schematic configuration of a recording apparatus according to an embodiment.

In addition, the ink jet type recording head 1 described above configures a portion of an ink jet type recording head unit having an ink flow path communicating with an ink cartridge or the like, and is mounted on an ink jet type recording apparatus. FIG. 13 is a schematic view showing an example of the ink jet type recording apparatus.

In the ink jet type recording apparatus I shown in FIG. 13, the plurality of recording heads 1 are detachably provided with an ink cartridge 2 constituting an ink supply unit, and a carriage 3 on which the recording head 1 is mounted is provided so as to be movable in the axial direction on a carriage shaft 5 attached to an apparatus main body 4.

The driving force of a drive motor 6 is transmitted to the carriage 3 through a plurality of gears (not shown) and a timing belt 7, so that the carriage 3 on which the recording head 1 is mounted is moved along the carriage shaft 5. On the other hand, the apparatus main body 4 is provided with a transport roller 8 as a transport unit, and a recording sheet S which is a recording medium such as paper is transported by the transport roller 8. The transport unit for transporting the recording sheet S is not limited to the transport roller, and may be a belt, a drum, or the like.

In the ink jet type recording apparatus I described above, the ink cartridge 2 as the ink supply unit is mounted on the carriage 3, but the invention is not particularly limited thereto. For example, the ink supply unit such as an ink tank may be fixed to the apparatus main body 4, and the ink supply unit and the recording head 1 may be connected via a supply tube such as a tube. In addition, the ink supply unit may not be mounted on the ink jet type recording apparatus.

In addition, in the ink jet type recording apparatus I described above, the recording head 1 is mounted on the carriage 3 and moves in the main scanning direction, but the invention is not limited thereto. For example, the invention can be applied to a so-called line type recording apparatus in which the recording head 1 is fixed and printing is performed by simply moving the recording sheet S such as paper in the sub-scanning direction.

Furthermore, the invention is broadly applied to liquid ejecting heads in general, and can be applied, for example, to a recording head such as various ink jet type recording heads used in an image recording apparatus such as a printer, a color material ejecting head used for manufacturing a color filter such as a liquid crystal display, an electrode material ejecting head used for forming an electrode of an organic EL display and an field emission display (FED), a bioorganic material ejecting head used for manufacturing biochip, and the like. In addition, although the ink jet type recording apparatus I is described as an example of a liquid ejecting apparatus, it can be used for the liquid ejecting apparatus using other liquid ejecting head described above.

In addition, the invention is widely applied to the piezoelectric device used for the liquid ejecting head.

What is claimed is:

1. A liquid ejecting head comprising:

a nozzle that ejects a liquid;

a pressure generation chamber that communicates with the nozzle;

a vibration plate that is formed on the pressure generation chamber which is provided in a flow path forming substrate;

a piezoelectric element that is provided on the vibration plate at a position corresponding to the pressure generation chamber;

a first liquid supply chamber that communicates with the pressure generation chamber, the first liquid supply chamber being provided in the flow path forming substrate;

a second liquid supply chamber that communicates with the first liquid supply chamber, the second liquid supply chamber being provided in a protective substrate;

a third liquid supply chamber communicating with the second liquid supply chamber;

a first filter that is provided between the first liquid supply chamber and the second liquid supply chamber, the first filter consisting of a plurality of first liquid supply ports connecting the first liquid supply chamber and the second liquid supply chamber; and a second filter that is provided between the second liquid supply chamber and the third liquid supply chamber, the second filter consisting of a plurality of second liquid supply ports connecting the second liquid supply chamber and the third liquid supply chamber, wherein an inner diameter of the second liquid supply port is an inner diameter or larger of the first liquid supply port.

2. The liquid ejecting head according to claim 1, wherein the first filter is formed by at least a portion of the vibration plate.

3. A liquid ejecting apparatus comprising:

the liquid ejecting head according to claim 2.

4. The liquid ejecting head according to claim 1, wherein the inner diameter of the first liquid supply port is an inner diameter of the nozzle or less.

5. A liquid ejecting apparatus comprising:

the liquid ejecting head according to claim 4.

6. The liquid ejecting head according to claim 1, wherein the second liquid supply chamber is provided penetrating the protective substrate in a lamination direction of the protective substrate and the flow path forming substrate, and the second filter is provided in an opening of the second liquid supply chamber on a surface of the protective substrate opposite to the flow path forming substrate.

7. The liquid ejecting head according to claim 6, further comprising:

a flow path member which forms the third liquid supply chamber, wherein the flow path member includes a beam portion that supports a surface of the second filter on the flow path member side.

8. A liquid ejecting apparatus comprising:

the liquid ejecting head according to claim 7.

9. A liquid ejecting apparatus comprising:

the liquid ejecting head according to claim 6.

10. The liquid ejecting head according to claim 1, wherein the first liquid supply chamber is independently provided in each of the pressure generation chambers.

11. A liquid ejecting apparatus comprising:

the liquid ejecting head according to claim 10.

12. The liquid ejecting head according to claim 1, wherein a compliance portion having flexibility is provided on a wall surface of the flow path between the first filter and the pressure generation chamber.

13. A liquid ejecting apparatus comprising:

the liquid ejecting head according to claim 12.

14. A liquid ejecting apparatus comprising:

the liquid ejecting head according to claim 1.

15. The liquid ejecting head according to claim 1, wherein the second filter is separate from and not connected to the first filter and provided on an upstream side of the first filter.

16. The liquid ejecting head according to claim 1, wherein the first filter and the second filter are provided on different substrates.

17. The liquid ejecting head according to claim 1, wherein the first filter is thicker than the second filter.

18. The liquid ejecting head according to claim 1, wherein the first filter is consisted from the vibration plate.

19. The liquid ejecting head according to claim 1, wherein the second filter is consisted from the protective substrate.

* * * * *